US006467882B2

(12) United States Patent
Inui et al.

(10) Patent No.: US 6,467,882 B2
(45) **Date of Patent: *Oct. 22, 2002**

(54) LIQUID JET RECORDING METHOD AND APPARATUS AND RECORDING HEAD THEREFOR

(75) Inventors: Toshiharu Inui; Kazuhiro Nakajima; Genji Inada, all of Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 120 days.

(21) Appl. No.: 07/967,412

(22) Filed: Oct. 28, 1992

(65) Prior Publication Data

US 2002/0008737 A1 Jan. 24, 2002

(30) Foreign Application Priority Data

| | | |
|---|---|---|
| Oct. 28, 1991 | (JP) | 3-281600 |
| Oct. 29, 1991 | (JP) | 3-283224 |
| Oct. 29, 1991 | (JP) | 3-283225 |
| Oct. 29, 1991 | (JP) | 3-283226 |
| Oct. 29, 1991 | (JP) | 3-283228 |
| Oct. 29, 1991 | (JP) | 3-283230 |
| Oct. 29, 1991 | (JP) | 4-283232 |

(51) Int. Cl.[7] ..... R41J 2/05
(52) U.S. Cl. ..... 347/56
(58) Field of Search ..... 346/140 R, 1.1; 347/47, 56, 61, 44, 25

(56) References Cited

U.S. PATENT DOCUMENTS

| | | | | |
|---|---|---|---|---|
| 4,410,899 A | * | 10/1983 | Haruta et al. | 347/56 |
| 4,638,337 A | | 1/1987 | Torpey et al. | 347/65 |
| 4,723,129 A | | 2/1988 | Endo et al. | 347/56 |
| 4,839,665 A | * | 6/1989 | Hertz et al. | 347/80 |
| 4,965,610 A | * | 10/1990 | Ishikawa | 347/61 |
| 4,999,646 A | * | 3/1991 | Trask | 347/41 |
| 5,148,186 A | * | 9/1992 | Tochihana et al. | 347/51 |
| 5,218,376 A | * | 6/1993 | Asai | 347/47 |
| 5,270,730 A | * | 12/1993 | Yaegashi et al. | 347/56 |

FOREIGN PATENT DOCUMENTS

| | | |
|---|---|---|
| JP | 54161935 | 12/1979 |
| JP | 55-100169 | 7/1980 |
| JP | 61-040160 | 2/1986 |
| JP | 61185455 | 8/1986 |
| JP | 61197246 | 9/1986 |

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

A liquid jet recording method using thermal energy to eject liquid from a liquid passage through an ejection outlet, the liquid passage being provided with a heat generating resistor, wherein at least one of the following conditions is satisfied:

$0.1 \leqq H/L \leqq 0.9$ $R/L \geqq 0.5$ $\phi/Wn \leqq 1.0$ $S/Sh \leqq 3.0$ where L is a distance between the heat generating resistor and the ejection outlet, H is a height of the liquid passage, R is a maximum diameter of the ejection outlet, $\phi$ is a converted diameter of the ejection outlet, Wn is a passage width of a portion where the heat generating resistor is disposed, S is an area of the ejection outlet, and Sh is an area of the. heat generating resistor; wherein a bubble created by heat generating resistor communicates with ambience.

26 Claims, 22 Drawing Sheets

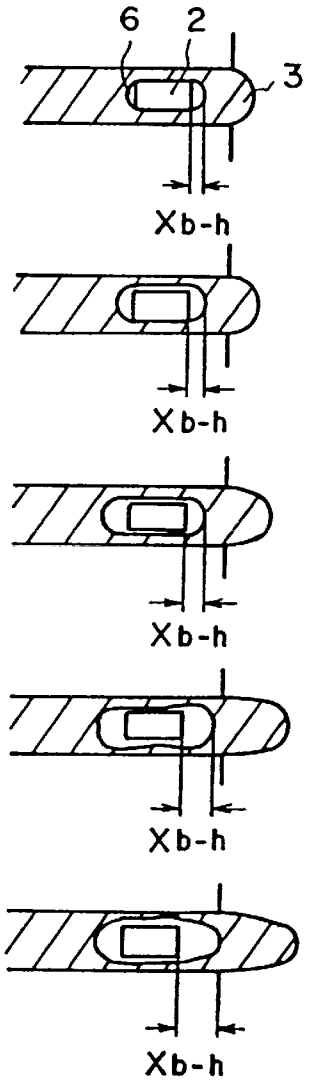
FIG. 10A-1
FIG. 10A-2
FIG. 10A-3
FIG. 10A-4
FIG. 10A-5
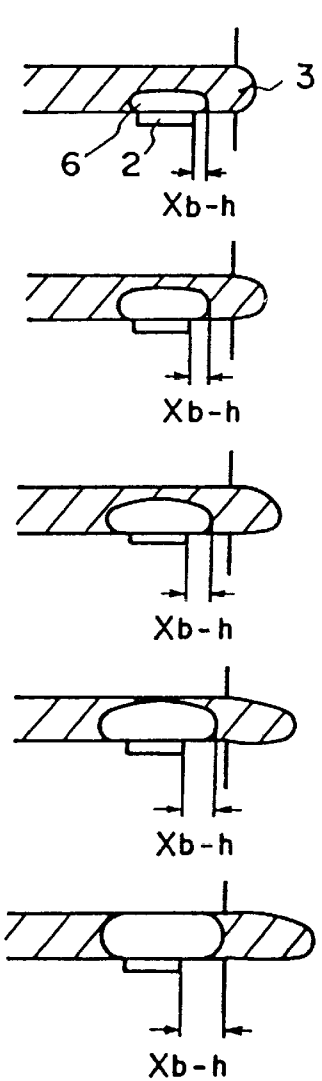
FIG. 10A-6
FIG. 10A-7
FIG. 10A-8
FIG. 10A-9
FIG. 10A-10

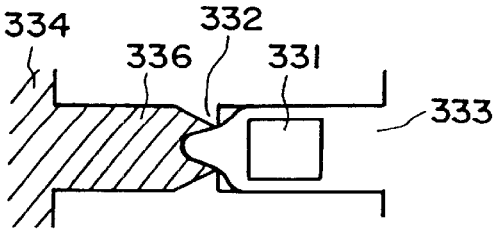
FIG. 13
FIG. 14(a)
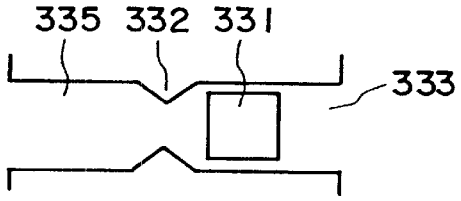
FIG. 14(b)
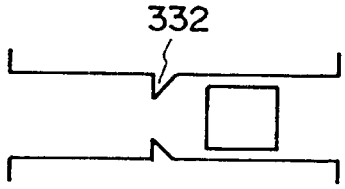
FIG. 14(c)
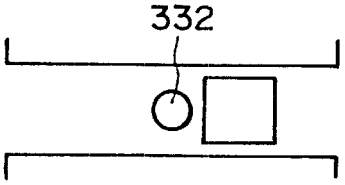
FIG. 14(d)
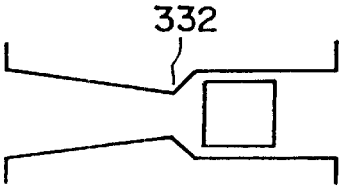
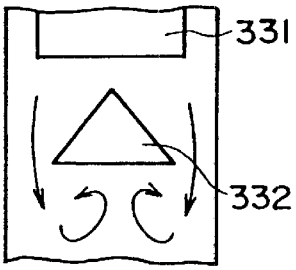
FIG. 15(a)
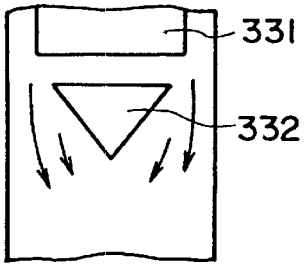
FIG. 15(b)

LIQUID JET RECORDING METHOD AND APPARATUS AND RECORDING HEAD THEREFOR

BACKGROUND OF THE INVENTION

FIELD OF THE INVENTION

The present invention relates to an ink jet recording method and apparatus and a recording head therefor in which liquid droplets are ejected using thermal energy onto a sheet of paper, resin sheet or cloth or another recording material.

In an ink jet recording method, the recording medium (ink), which is in the form of a liquid material or a heat-soluble solid material is deposited on the recording material, using thermal energy. The recording method has the advantages of high speed recording (relatively high recording quality and low noise). In addition, the method is relatively easily applicable to color image recording on a plain sheet of paper or cloth or the like. A further advantage is that the size of the apparatus is small.

The ink jet recording apparatus using this method comprises a recording head which has ejection outlets for ejecting the ink in the form of droplets, ink passages communicating with the ejection outlets and energy generating means for applying ejection energy to the ink in the liquid passages. U.S. Pat. No. 4,723,129 discloses a method in which the energy generating means is in the form of an electrothermal transducer, and the thermal energy produced by the application of an electric pulse is applied to the ink so as to eject the ink.

In the recording method disclosed in the above U.S. Patent, the ink, having received the thermal energy, is subjected to a state change, which causes a quick volume change, by film boiling of the liquid. By the development and contraction of a bubble, the ink is ejected through the ejection outlet at one end of the recording head. The ejected droplets of the ink are deposited onto the recording medium to form an image. According to this recording method, ejection outlets may be a arranged at high density in a recording head, and therefore, high speed, high resolution and high quality images can be recorded. A recording apparatus using this method can be used as a copy machine, printer, facsimile machine or other information outputting means.

Japanese Laid-Open Patent Application No. 161935/1979 discloses that ink in an ink chamber is gasified by a cylindrical heat generating element, and the gas is ejected through an ink ejection outlet together with ink droplets. According to this method, the gas and fine droplets or splashed, resulting in a low quality image. In addition, the ink is further gasified by the splash, resulting in the production of ink mist, which further contaminates the background of the recorded image or the inside of the recording apparatus.

Japanese Laid-Open Patent Application No. 197246/1986 discloses a modified ink jet recording method or thermal transfer recording method, in which single ink ejection is effected. In this method it is difficult to have the heat generating element come into complete contact with the recording material, and therefore, the thermal efficiency tends to decrease as compared with an ink jet recording method using a recording head having the conventional ejection outlets. Therefore, this method is not suitable for high speed recording.

On the other hand, U.S. Pat. No. 4,638,337 discloses, as prior art, a recording method in which a bubbles communicates with the ambient air. However, the communication between the bubble and the ambience occurs adjacent the heat generating element, not adjacent the ejection outlet. For this reason, this method easily introduces air into the neighborhood of the heat generating element, resulting in unstable ink ejection, as described in the patent. Japanese Laid-Open Patent Application No. 185455/1986 discloses that liquid ink contained in a small clearance area formed between a plate having a small opening and a heat generating member head is heated by the heat generating member, so that the ink is ejected in the form of a droplet through the small opening by a bubble produced by film boiling, and the gas constituting the bubble is also ejected through the small opening, to effect the recording of an image on a recording sheet.

Japanese Laid-Open Patent Application No. 249768/1986 discloses an ink jet recording apparatus in which thermal energy is applied to liquid ink to produce a fairly large bubble to eject a small droplet of ink by the expansion force of the bubble, wherein the gas constituting the bubble is also ejected into the ambience.

However, the above-discussed Japanese Laid-Open Patent Applications Nos.—161935/1979, 185455/1986 and 249768/1986 have in common the characteristic that the gas constituting the bubble is ejected into the ambience in the form of a fine ink mist together with the main ink droplet. As a result, the gasified ink produced by the gas ejection splashes to produce an ink mist, resulting in background contamination of the recording sheet or contamination inside the apparatus.

In order to solve the above problems of the ink jet recording system, U.S. Ser. No. 692,935 has proposed that the bubble produced by the film boiling is caused to communicate with the ambience adjacent to the ejection outlet (a communication ejection system).

With this communication ejection system, the gas constituting the bubble is not ejected with the ink droplet, so that the production of the splash or mist is reduced, and therefore, the contamination of the recording material and the inside of the apparatus can be prevented.

A fundamental characteristic of the communication ejection system is that the ink downstream of the bubble formation position is, in principle, all ejected out. Therefore, the amount of ejected ink can be determined on the basis of characteristics of the structure of the recording head, such as the distance from the ejection outlet to the bubble formation position. As a result, in the communication ejection system, the ejection amount can be stabilized without employing or being affected by the influence of the ink temperature or the like.

However, in the case in which the heat generating portion and the ejection outlet portion are positioned opposed to one another, the formed bubble is sometimes not stably communicated with the ambience, with the result that ejection performance changes.

On the other hand, a liquid jet recording method using thermal energy has various advantages, and the various types of image processing are effected in a manner similar to other types of dot matrix printers. In such processing, a gray scale is provided depending on the number of dots, or a great number of dots are concentrated on a predetermined area to control the tone level. If this method is used, another problem arises.

When recording is performed with a plurality of liquid droplets and when 4 level recording is effected for 4 kHz bi-level recording, 4×3=12 kHz is required. If the recording head is operated at such a high frequency, the temperature of the recording head increases significantly. In addition, a large temperature difference is produced depending on the frequency used, resulting in a very large variation in the droplet size.

In liquid jet ejection using thermal energy, the volume of the droplet and the ejection speed thereof easily change depending on changes in the properties of the liquid due to thermal energy, and this tendency is mots marked if a larger number of liquid droplets are concentrated in a small area.

At present, these problems have been avoided by decreasing the recording speed, because otherwise the image processing and the performance of the recording head are not adequate. Or, alternatively, the recording operation is interrupted for the purpose of promoting the fixing of the liquid on the recording material. Therefore, the above problems have not appeared as significant problems. However, if higher image quality is required, such that the number of droplets concentrated on the same area must be increased, and the volume of a single droplet made smaller and more stabilized, then these problems will reappear. The variations in the liquid droplets in the present recording head occur not only in the long term but also within a single line of printing. Before high image quality can be achieved, these problems have to be solved.

SUMMARY OF THE INVENTION

Accordingly, it is a principal object of the present invention to provide an ink jet recording method and apparatus, and a recording head using the same, of a communication ejection type, in which the ink droplet formation is further stabilized to improve the image quality.

It is another object of the present invention to provide an ink jet recording method and apparatus and a recording head using the same in which the ink meniscus, which is retracted far behind the ejection, outlet by the communication ejection is quickly returned to the original position.

It is a further object of the present invention to provide an ink jet recording method and apparatus, and a recording head using the method, in which the ejection performance is improved to enable higher frequency ink elections, in which the liquid droplet is ejected at high speed, with stability and substantially without volume change of the liquid droplet even when the recording system is such that a large number of droplets are ejected during a short period of time, as in the case where a large number of droplets are concentrated on a small area or when high speed printing is carried out by multi-nozzles.

According to an aspect of the present invention, there is provided a liquid jet recording method using thermal energy to eject liquid from a liquid passage through an ejection outlet, the liquid passage being provided with a heat generating resistor, wherein at least one of the following conditions is satisfied:

$0.1 \leqq H/L \leqq 0.9$ $R/L \geqq 0.5$ $ø/Wn \leqq 1.0$ $S/Sh \leqq 3.0$ where L is a distance between the heat generating resistor and the ejection outlet, H is a height of the liquid passage. R is a maximum diameter of the ejection outlet, ø is a converted diameter of the ejection outlet, Wn is a passage width of a portion where the heat generating resistor is disposed, S is an area of the ejection outlet, and Sh is an area of the heat generating resistor; wherein a bubble created by the heat generating resistor communicates with the ambience.

According to another aspect of the present invention, there is provided a recording head comprising: a liquid ejection outlet, a liquid passage in communication with the ejection outlet, and an electrothermal transducer having a heat generating resistor for supplying thermal energy to the liquid in the passage to eject the ink through the ejection outlet by creation of a bubble in the liquid in the liquid passage, wherein at least one of the following conditions is satisfied:

$0.1 \leqq H/L \leqq 0.9$ $R/L \geqq 0.5$ $ø/Wn \leqq 1.0$ $S/Sh \leqq 3.0$ where L is a distance between the heat generating resistor and the ejection outlet, H is a height of the liquid passage, R is a maximum diameter of the ejection outlet, ø is a converted diameter of the ejection outlet, Wn is a passage width of a portion where the heat generating resistor is disposed, S is an area of the ejection outlet, and Sh is an area of said heat generating resistor; wherein a bubble created by the heat generating resistor communicates with the ambience.

According to a further aspect of the present invention, there is provided a liquid jet recording method in which liquid is ejected through an ejection outlet from a liquid passage by thermal energy from a heat generating resistor, wherein a flow resistance element is provided upstream of the heat generating resistor in the liquid passage, and a bubble created by the heat generating resistor communicates with the ambience adjacent the ejection outlet, when the liquid is ejected through the ejection outlet.

According to a further aspect of the present invention, there is provided a liquid jet recording method in which liquid is ejected through as ejection outlet by thermal energy provided by a heat generating resistor by creating a bubble in the liquid in the liquid passage, wherein the bubble communicates with the ambience adjacent the ejection outlet, and one pixel is recorded by plural droplets of the liquid ejected through the ejection outlet.

The present invention is suitably usable under one or more of the following conditions:

(1) When the ink is ejected, the ink is not disconnected into two portions by the bubble.

(2) When the bubble is brought into communication with the ambience, the internal pressure of the bubble is not higher than the ambient pressure.

(3) When the bubble is brought into communication with the ambience, the acceleration of the front end of the bubble toward the ejection outlet is not positive.

(4) When the bubble is brought into communication with the ambience, $1a/1b>1$ is satisfied, where 1*a* is distance between an ejection outlet side edge of the flat heater and a front end of the bubble, and 1*b* is a distance between such an edge of the heater as is opposite the outlet side edge and the rear end of the bubble.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 10A-1 through 10A-10 and 10B-1 through 10B-4 show the change of the front end of the bubble per unit time. In FIGS. 10A-1 through 10A-5, a top sectional view is shown, and in FIGS. 10A-6 through 10A-10, a side sectional view is shown, both having the same time scale.

FIG. 13 shows another example of the recording head.

FIGS. 14(*a*)–14(*d*) illustrate another example of the recording head.

FIGS. 15(*a*) and 15(*b*) illustrate the functioning of a flow resistance element.

DESCRIPTION OF THE PREFERRED EMBODIMENTS

Figures 1, 10B:
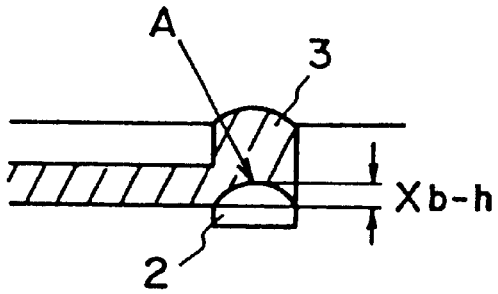

First, the description will be made as to four conditions A, B, C and D which are employed in the present invention, and the description will be made thereafter as to the communication of the bubble with the ambience. FIGS. 1(*a*) and 1(*b*) illustrate the second condition, that is, condition B. FIGS. 1(*a*) and 1(*b*) show an example of a recording head having circular ejection outlets 5, ink passage 12, substantially square heat generating resistors 2, and an insulative base plate 1 supporting the heat generating resistors. The ink passage is bent at the heat generating resistor portion, and the heat generating portion 2 faces the associated ejection outlet 5. An orifice plate 8 is cooperative with the ink passage 12 to form an orifice.

In order to eject the ink (FIG. 3A) while the bubble produced by the heater communicates with the ambience through the ejection outlet, the size of the heater, the distance between the ejection outlet and the heater, the width, length and height of the liquid passage, and the size of the ejection outlets or the like, are considered.

The description will now be made as to the first condition, that is, condition A. This is the condition for efficiently causing the bubble produced by the heater to communicate with the ambience through the ejection outlet and for providing a constant size (volume) of the ink droplet ejected through the ejection outlet, more particularly, for improving refilling by means of the communication between the bubble and the ambience adjacent the ejection outlet. For this purpose, the distance L between the ejection outlet and the heater and the height H of the liquid passage are significant among the above-mentioned various factors. The second condition is particularly directed to the lower limit, and more particularly, it is preferable that $0.1 \leqq H/L \leqq 0.9$ is satisfied. If $H/L > 0.9$, it becomes difficult to efficiently cause communication between the ambience and the bubble through the ejection outlet. More particularly, the bubble created by the heater will communicate with the ambience though the ejection outlet, but the bubble tends to expand along the liquid passage with the result of slower refilling, and therefore, continuous and efficient bubble elections are not expected. In addition, the ink remains between the ejection outlet and the heater after the communication in some cases, and therefore, it is not preferable from the standpoint of maintaining a constant size of the ink droplets.

If $H/L < 0.1$, the height of the liquid passage is substantially low with the result of a longer time period required for refilling the ink after the ink ejection, such that it becomes difficult to drive the recording head at a high frequency with stability, while the bubble communicates with the ambience adjacent the ejection outlet.

In regard to the above described condition, $0.2 \leqq H/L, \leqq 0.8$ is further preferable. When this is satisfied, the ink can be ejected mores efficiently while the bubble communicates with the ambience through the ejection outlet, and therefore, the refilling performance is further improved. Then, the ink hardly remains adjacent the ejection outlet, and therefore, the volume of the ink droplet can be stabilized at all times. Also, the recording head can be driven at practically higher frequency.

Still more preferably, $0.35 \leqq H/L \leqq 0.65$ is satisfied, since then the ink refilling performance can be further improved by directing the expansion of the bubble toward the ejection outlet side rather than the upstream side. By doing so, the recording operation is stabilized even under the existence of other factors that would tend toward instability.

Table 1 shows the results of testing. In the Table, R is a diameter of the ejection outlet, H is the height of the liquid passage, b is the width of the liquid passage, and c is the length of the liquid passage. In Examples 1–5, the ejection frequency was 4 kHz, and the driving pulse was 3 $\mu$sec.

From this table, it will by understood that Examples 1–3 satisfying the above condition showed good results, whereas Examples 4 and 5 not satisfying the above condition did not show satisfactory continuous ejections with stability while the ambience and the bubble communicate adjacent the ejection outlet.

TABLE 1

| Example | L | Heater Size | R | H | b | c | H/L | Ejection |
|---|---|---|---|---|---|---|---|---|
| 1 | 20 | 20 × 20 | 33 | 10 | 36 | 50 | 0.5 | Good |
| 2 | 40 | 32 × 32 | 47 | 10 | 50 | 80 | 0.25 | Good |
| 3 | 50 | 32 × 32 | 47 | 30 | 50 | 80 | 0.75 | Good |
| 4 | 25 | 20 × 20 | 33 | 2 | 36 | 50 | 0.08 | *1 |
| 5 | 50 | 40 × 40 | 60 | 46 | 60 | 75 | 0.92 | *2 |

*1 Unstable ejection, Sword-like droplet, Stable with 1 kHz
*2 Sometimes unstable ejections The description will now be made as to the second condition. In order to efficiently cause the communication between the ambience and the bubble created by the heater adjacent the ejection outlet with the constant site (volume) of the ink droplet ejected through the ejection outlet, it it desirable to prevent ink from remaining adjacent the ejection outlet at the time of ejecting action. In order to assure this, it is desirable that $R/L \geqq 0$ is satisfied, where L is the distance between the ejection outlet and the heat generating element, and R is the maximum diameter of the ejection outlet.

When the above relation is not satisfied, it is difficult to eject the ink with efficient communication of the created bubble with the ambience through the ejection outlet. More particularly, the inertance (inertia resistance) between the heater and the ejection outlet increases in effect, and therefore, the bubble is not easily expanded toward the ejection outlet. Therefore, even if the bubble communicates with the ambience through the ejection outlet, the ink tends to remain between the ejection outlet and the heater with the result of introduction of air into the passage. If this occurs, an air bubble sticks in the passage with the possible result of ejection failure or of varied ink droplet volumes if the ink droplets are ejected.

In regard to the above condition $0.5 \leqq R/L \leqq 5.0$ is preferable since then, the bubble efficiently communicates with the ambience while the ink droplet is ejected, and therefore, the ink hardly remains adjacent the ejection outlet, thus stabilizing the volume of the ink droplet. It is still more preferable for the purpose of stabilized continuous ejections if $0.7 \leqq R/L \leqq 3.0$ is satisfied.

Table 2 shows the results of experiments, wherein R is the maximum diameter of the ejection outlet, and L is a distance between the ejection outlet and the heat acting surface of the thermal energy supply means, a is a height of the liquid passage, b is a width of the liquid passage, and c is a length of the liquid passage. In Examples 1–6, the ejection frequency was 4 kHz and the driving pulse was 3 μsec. The driving voltages are 7 V in Example 1, 13.5 V in Example 2, 7 V in Examples 3–5, and 15.4 V in Example 6. The orifice density was 360 dpi (multi-head).

As will be understood from the table, the results are satisfactory in Examples 1, 2, 4, 5 and 6. Example 3 not satisfying the above-described condition B did not show a good result, that is, continuous stabilized ejection with bubble communication with the ambience adjacent the ejection outlet was not achieved

TABLE 2

| Example | R | L | Heater size | a | b | c | R/L | Ejection speed | Ejection |
|---|---|---|---|---|---|---|---|---|---|
| 1 | 31 | 20 | 18 × 18 | 10 | 31 | 50 | 1.55 | 14.1 | Good |
| 2 | 45 | 45 | 35 × 35 | 30 | 51 | 80 | 1.00 | 9.5 | Good |
| 3 | 30 | 80 | 18 × 18 | 10 | 34 | 50 | 0.38 | — | Not continuously ejectable |
| 4 | 30 | 55 | 18 × 18 | 10 | 34 | 50 | 0.55 | 5.0 | Continuously ejectable |
| 5 | 80 | 20 | 50 × 50 | 10 | 85 | 50 | 4.00 | 10.0 | Good |
| 6 | 60 | 25 | 40 × 40 | 20 | 64 | 80 | 2.40 | 11.0 | Good |

Now, the description will be made as to the third condition, that is, condition C. In order to cause the bubble created by the heater to communicate with the ambience through the ejection outlet with stability and high efficiency in continuous drive and in order to provide a constant volume of the liquid droplet ejected, $ø2/Wn \leqq 1.2$ should be satisfied, where ø2 is a converted orifice (ejection outlet) diameter, and Wn is a nozzle (liquid passage) width where the thermal energy generating means is disposed. Further preferably, $ø2/Wn \leqq 0.97$ should be satisfied.

If this is not satisfied, the continuous ejection while the bubble communication with the air through the ejection outlet is constant, is not continuously stabilized. More particularly, if this condition is not satisfied, the flow resistance between the heater and the orifice becomes relatively large as compared with the energy of the bubble supplied for the purpose of ink ejection, and therefore, it is difficult for the bubbly to expand toward the orifice. Therefore, even if the bubble communicates with the ambience through the orifice, a large amount of ink mist is produced with the result of contamination of the image, or the ink easily remains between the orifice and the heater. If this occurs, air is introduced into the passage with the result of formation of a fixed air bubble with the possible result of ejection failure or of varied (non-constant) volumes of the droplets if they are ejected.

Even further preferably, $0.15 \leqq ø2/Wn \leqq 0.95$ should be satisfied. If this is satisfied, the bubble is caused to communicate with the ambience through the orifice continuously and efficiently. Other preferably, $0.4 \leqq ø2/Wn \leqq 0.95$. Even further preferably, $0.7 \leqq 02/Wnø \leqq 92$. Even more preferably, $0.15 \leqq ø2/Wn \leqq 0.95$ for the continuous and stabilized and efficient liquid ejection with communication of the bubble with the ambience and substantially without ink remaining adjacent the orifice, and therefore, with the constant volumes of the liquid droplets.

Embodiment 1

Figures 2, 10B:
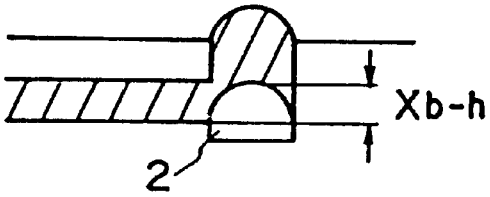
Figures 3, 10B:
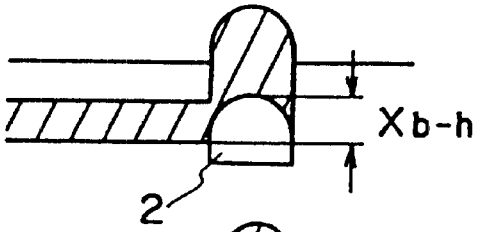
Figures 4, 10B:
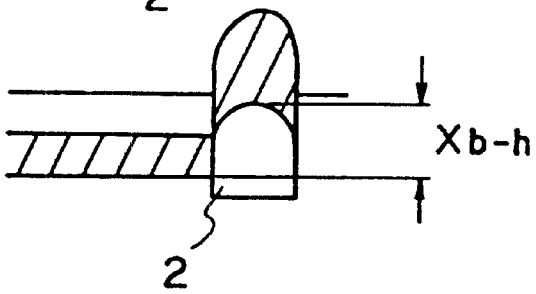

Ink ejection operations were carried out using an ink jet recording head shown in FIGS. 2(*a*) and 2(*b*). The nozzle was produced through the following steps. Two kinds of photosensitive resin are laminated on a base plate 1 in an overlying relation, and they are exposed to different predetermined patterns to produce nozzle walls 9 and orifice plates 8. In this embodiment, the orifice diameter ø2 was 23 μm, the heater area Sh was 18×18 $\mu m^2$, and the nozzle width where the heater is disposed Wn was 30.0 μm. The heater was supplied with a pulse voltage having a width of 3.0 μsec and 7.0 V. Therefore, in this embodiment, ø2/Wn is 0.77. In operation, it was confirmed that the liquid was ejected while the bubble was communicating with the ambience through the orifice. Continuous ejecting operations were carried out on a recording material at a driving frequency of 2.0 kHz, and it was confirmed that substantially the same size of dots could be provided with stability, that is, the volume of the liquid droplet was substantially constant (Table 3, No. 6).

The dimensions of the major parts of FIGS. 2(*a*) and 2(*b*) were selected as shown in Table 3 to investigate the ejecting state of the liquid droplets and the communication states between the bubble and the ambience. As a result, the significance of ø2/Wn has been determined. Particularly, when $ø2/Wn \geqq 1.07$, the ink mist and satellite droplets are significantly produced with remarkable contamination of the image. When ø2/Wn is 1.0, the ink mist and the satellite droplets are slightly produced, and the images quality was not remarkably reduced. Such defects are not found when $ø2/Wn \leqq 0.97$. The bubble communicates with the ambience through the ejection outlet, so that continuous ejecting operations were possible. Therefore, the upper limit of ø2/Wn is about 1.0 in order to provide a good image with continuously assured communication between the bubble and the ambiance through the orifice. If ø2/Wn is larger than 1.0, ink remains in the nozzle, and the liquid volume varies significantly. In other words, if ø2/Wn≧1.07, the volume variation of the liquid droplets is so large that the features of the present invention are not provided sufficiently. In addition, if ø2/Wn≦0.24, the reproducibility of the communication state between the bubble and the ambience through the orifice is sometimes deteriorated, with slight variation of the liquid volumes. Therefore, if consideration is paid to the variation curing the nozzle formation, the practical range for providing stabilized ejection is 0.15≦02/Wn≦1.0, and more preferably, ø.4≦02/Wn≦0.97.

TABLE 3

| No. | ø2 | Sh | Wn | ø2/Wn | Image | Drop Volume Variation |
|---|---|---|---|---|---|---|
| 1 | 35 | 324 | 30 | 1.17 | N | N |
| 2 | 32 | 324 | 30 | 1.07 | N | N |
| 3 | 30 | 324 | 30 | 1 | F | G |
| 4 | 29 | 324 | 30 | 0.97 | G | G |
| 5 | 27 | 324 | 30 | 0.90 | G | G |
| 6 | 23 | 324 | 30 | 0.77 | G | G |
| 7 | 18 | 324 | 30 | 0.6 | G | G |
| 8 | 12 | 324 | 30 | 0.4 | G | F |
| 9 | 12 | 900 | 50 | 0.24 | G | F |
| 10 | 6 | 900 | 40 | 0.15 | G | F |

Now, the fourth condition, that is, condition D, will be described. Another condition to efficiently and stably communicate the bubble created by the heater with the ambience through the orifice, while the volume of the droplet is constant, relatively easily,this condition is directed to the relation between the orifice area S and the heater cross-sectional area Sh. In particular, it is desirable that S/Sh<3.0 be satisfied.

If this is not satisfied, it is difficult to cause communication between the bubble and the orifice at high efficiency and stability. More particularly, the flow resistance between the heater and the orifice becomes large relative to the energy of the bubble supplied for the purpose of ink ejection, and therefore, the bubble is not easily expanded toward the orifice. Therefore, even if the bubble communicates with the ambience through the orifice, ink tends to remain between the orifice and the heater with the result that air is introduced, forming a fixed bubble. If this occurs, ejection failure may occur, or the volume of the droplets of the liquid vary if they are ejected. Therefore, the, required volume is not provided easily.

It is further preferable that 0.02≦S/Sh≦3.0. If this is satisfied, the bubble can communicate with the ambience through the orifice with stability and high efficiency with a desired volume of the ejected droplet. An even further preferable range is 0.15≦S/Sh≦2.0. If this is satisfied, the further stabilized bubble communication with the ambience through the orifice can be accomplished when the droplet is ejected. The volume of the droplet can be stabilized substantially without ink remaining between the orifice and the heater.

EXAMPLE 1

Using the ink jet head shown in FIGS. 2(*a*) and 2(*b*), ink has been ejected. The nozzle has been produced in the following manner. Two kinds of photosensitive resin are laminated on the substrate in an overlapping relation. Predetermined patterns are separately projected thereon to form nozzle wall 9 and orifice plate 8. In this embodiment, the orifice diameter ø2 was 23 μm, the heater area Sh was 18×18 $\mu m^2$, and the distance h between the orifice and the heater was 24 μm. The driving voltage was in the form of a pulse having a pulse width of 3.0 μsec and voltage level of 7.0 V. Thus, S/Sh was 1.28, in this embodiment. As a result, the liquid was ejected while the bubble was communicating with the ambience through the orifice. In this state, continuous ejecting operations were performed on a recording medium at a drive frequency of 2.0 kHz. It was confirmed that, dots having substantially the same size are stably produced, and therefore, the volume of the droplet was substantially constant (Table 4, No 6).

EXAMPLE 2

The major dimensions of the structure shown in FIGS. 2(*a*) and 2(*b*) were selected as shown in Table 4 (lengths: μm, and areas: $\mu m^2$). The investigations have been made as to the communication of the bubble with the ambience through the orifice and as to the ejecting state of the liquid. As a result, the significance of the relation between the orifice area S and the heater area Sh has been determined. In particular, if S/Sh≧3.14, ejection failure due to production of a fixed bubble is observed. If S/Sh≦3.04, the bubble communicates with the ambience through the orifice in continuous ejecting operations. If, however, the dimensional variations due to the accuracy of the pattern on the photosensitive resin are considered, the upper limit S/Sh for communication of the bubble with the ambience through the orifice is approximately 0.3. When 2.09≦S/Sh≦3.04, or when S/Sh is smaller than 0.02, the reproducibility of the communication of the bubble with the ambience through the orifice sometimes become worse, with the result of variation of the droplet volume. Therefore, taking the variation in the production of the nozzle formation into account, the practically desirable range is 0.02≦S/Sh≦2.0. It is further preferable that 0.15≦S/Sh≦2.0, since then, the bubble is communicated with the ambience through the orifice substantially without variation of the liquid volume.

TABLE 4

| No. | ø2 | Sh | H | S/Sh | Ejection Stability |
|---|---|---|---|---|---|
| 1 | 31 | 225 | 22 | 3.35 | N |
| 2 | 31 | 240 | 22 | 3.14 | N |
| 3 | 31 | 248 | 22 | 3.04 | F |
| 4 | 31 | 360 | 22 | 2.09 | G |
| 5 | 27 | 360 | 22 | 1.59 | G |
| 6 | 23 | 324 | 22 | 1.28 | G |
| 7 | 18 | 324 | 22 | 0.79 | G |
| 8 | 12 | 324 | 22 | 0.35 | G |
| 9 | 6 | 196 | 22 | 0.14 | G |
| 10 | 6 | 400 | 40 | 0.07 | F |
| 11 | 6 | 900 | 40 | 0.03 | F |
| 12 | 6 | 1225 | 40 | 0.02 | F |

In the foregoing, conditions A–D are described. Advantageous effects are provided if any one of them is satisfied. However, it is preferable that a larger number of conditions are satisfied, because then the advantageous effects are further enhanced.

Figure 1A:
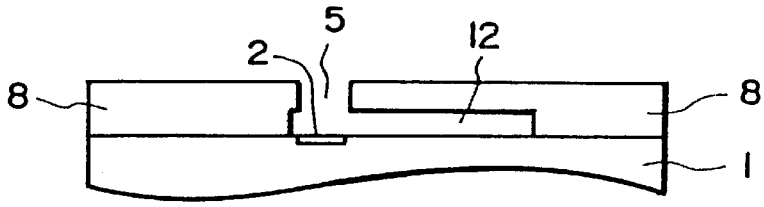
FIGS. 1(*a*) and 1(*b*) are a sectional view and a top plan view, respectively, of an ink jet recording head for illustrating the present invention.
Figure 1B:
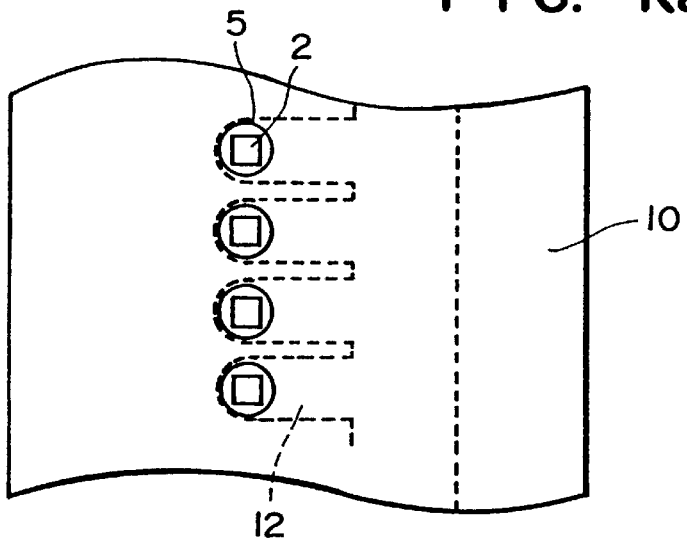
Figure 2A:
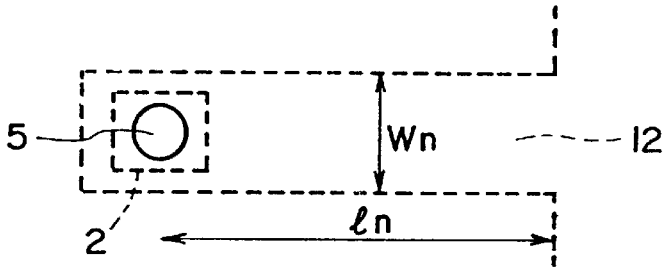
FIGS. 2(*a*) and 2(*b*) are a top plan view and a sectional view, respectively, of an ink jet recording head for illustrating the present invention.
Figure 2B:
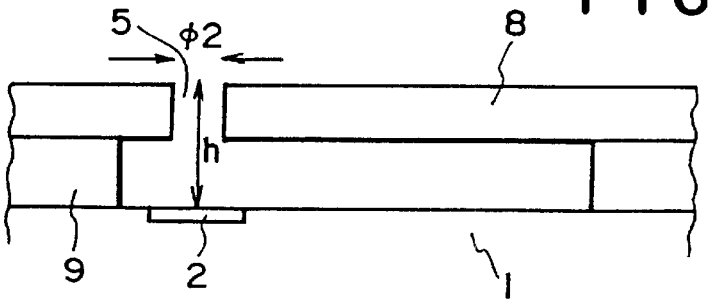
Figure 3A:
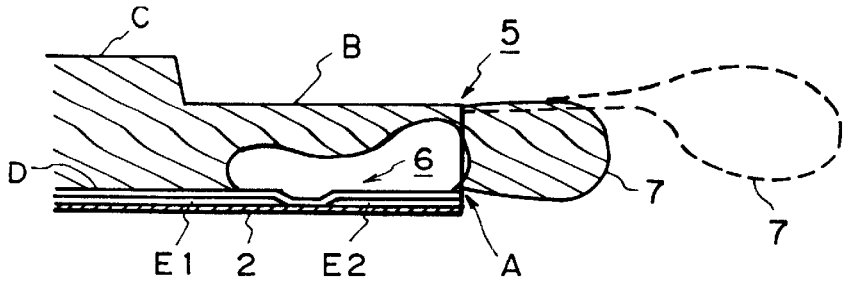
FIGS. 3A–3C illustrate communication of a bubble with the ambience.
Figure 3B:
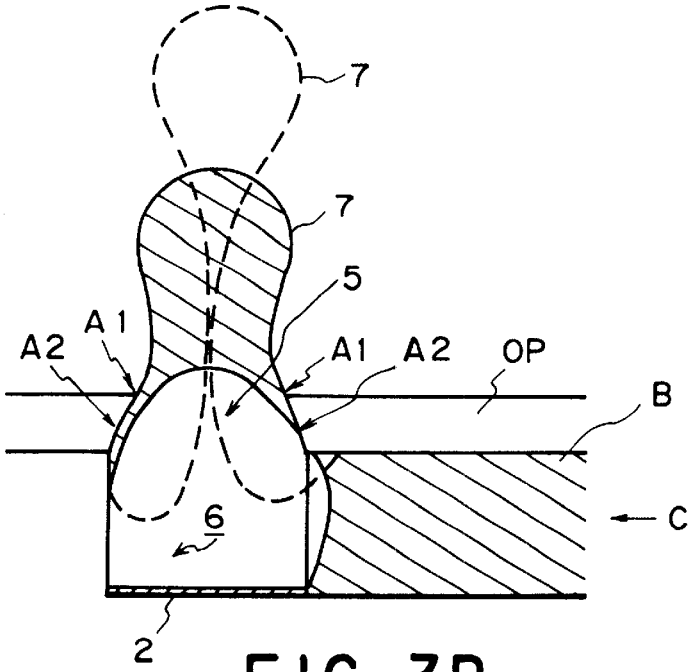

FIGS. 3A and 3B show typical examples of liquid passages using the present invention. However, the present invention is not limited to these structures, as will be understood from the descriptions which will be made hereinafter.

In FIG. 3A, a heat generating resistor layer 2 is provided on a unshown base plate, and a plurality of ejection outlets 5 are provided at an edge of the base plate. A selecting electrode E1 and a common electrode E2 have known structures. Designated by reference characters D and C are a protection layer and a common liquid chamber, respectively.

In response to electric signals in the form of pulse signals in accordance with the recording signals supplied by the electrodes E1 and E2, the temperature of the heat generating portion between the electrodes E1 and E2 instantaneously rises to cause film boiling (not less than 300° C.), by which a bubble 6 is produced. In the embodiments of the present invention, the bubble 6 communicates with the ambience at its edge A adjacent the heat generating resistor layer 2 to produce a stabilized liquid droplet (broken line 7). Since the bubble communicates with the ambience (atmospheric air) adjacent the edge of the ejection outlet opening 5, a droplet of ink can be created without splashing of the liquid and without the production of mist. The thus produced droplet of the liquid is ejected and deposited on the recording material.

The recording principle is such that the liquid passage B is not completely blocked by the bubble 6 during the growth thereof. Therefore, the ink refilling after the ejection is effected in good order. The accumulated heat by the high temperature (not less than 300° C.) is ejected into the ambience, and therefore, the frequency of the response is increased.

In FIG. 3B, the common liquid chamber C is not shown. The liquid passage B is bent, as contrasted to the structure of FIG. 3A, and the heat generating resistor 2 is provided on the surface of the base plate at the bent portion. The ejection outlet has a cross-section decreasing in the direction of the ejection and faces the heat generating resistor 2. The ejection outlets are formed in the orifice plate OP. The above described conditions A–D are particularly suitable in this structure.

Similarly to the structure of FIG. 3A, film boiling (not less than 300° C.) is caused, by which the bubble 6 develops to displace the ink in the thickness of the orifice plate OP. The bubble 6 communicates with the ambience in a region between A1, which is an outside edgy of the ejection outlet opening 5, and A2, which is adjacent to the ejection outlet opening. With this state of communication, a stabilized liquid droplet as shown by the broken line 7 can be ejected along the center of the ejection outlet without splashing of the liquid and without production of the mist. The growth of the bubble does not block the liquid passage. More particularly, when the bubble communicates with the ambiance, the bubble does not completely block the passage. Rather, the liquid which is going to constitute the droplet is partly connected with the liquid in the liquid passage. This increases the speed of refilling of the liquid in the passage.

Figure 3C:
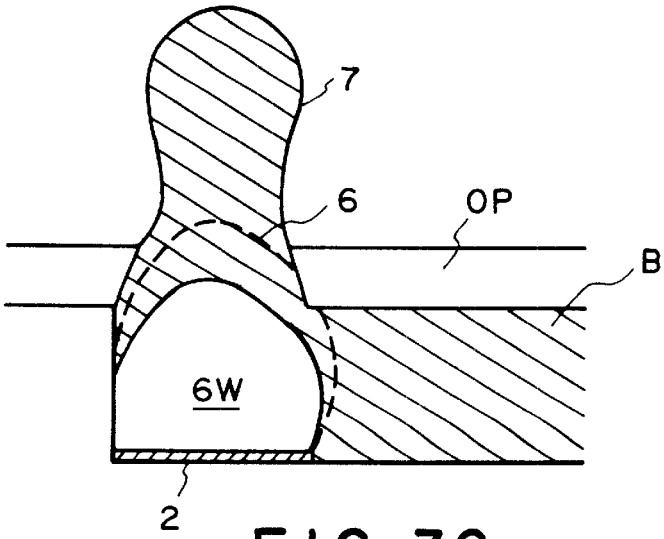

As shown in FIG. 3C, the liquid (hatched portion) in the liquid passage B in this embodiment, too, is in communication with the liquid droplet 7 being ejected. When the bubble 6 adjacent the ejection outlet in the central portion communicates with the ambience adjacent to the ejection outlet, the liquid droplet 7 and the liquid passage communicate with each other. Reference character 6W designates the configuration of an end of the bubble in the cross section.

As described hereinbefore, similarly in FIG. 3A, when the bubble communicates with the ambience, the liquid in the passage is gradually separated from the liquid droplet, while keeping the connection therebetween, and therefore, splashing can be prevented.

The description will now be made as to the preferable conditions which may be incorporated individually or in combination in the structures shown in FIG. 3A or 3B to provide significantly better liquid droplet formation.

The first condition is that the bubble communicates with the ambience under the condition that the internal pressure of the bubble is lower than the ambient pressure. The communication under such a condition is preferable since then the unstable liquid adjacent the ejection outlet is thereby prevented from scattering, whereas such liquid is scattered when the condition is not satisfied. In addition, satisfaction of this condition is advantageous in that the force, even if not large, is applied to the unstable liquid in the backward direction, by which the liquid ejection is further stabilized, and unnecessary liquid splashing can be suppressed.

The second condition is that the bubble communicates with the ambience under the condition that the first order differential of a movement speed of the front edge (the edge adjacent to the ejection outlet) of the bubble is negative.

The third condition is that the bubble communicates with the ambience under the condition of $\mathbf{1}_a/\mathbf{1}_b>1$, where 1*a* is a distance from an ejection outlet side edge of the ejection energy generating means to the ejection outlet side edge of the bubble, and $\mathbf{1}_b$ is a distance from the edge of the energy generating means remote from the ejection outlet to the edge of the bubble remote from the ejection outlet. It is further preferable that the second and third conditions are simultaneously satisfied.

The description will now be made as to the structure of the recording head used in the present invention.

Figure 4A:
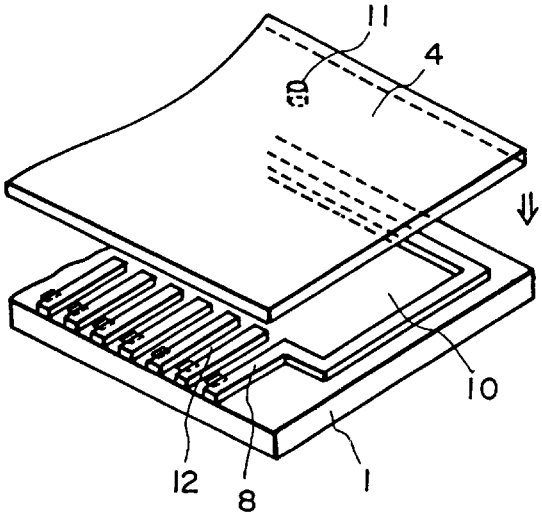
FIGS. 4A–4B illustrate a recording head using the present invention.
Figure 4B:
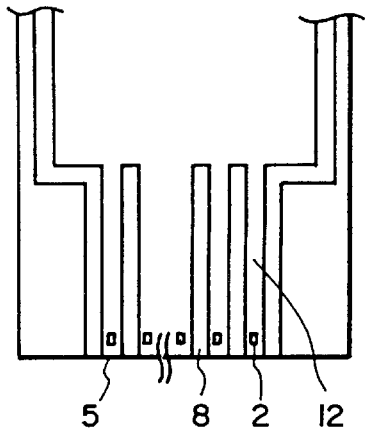

FIGS. 4A and 4B are a perspective view of a preferable recording head before the assembling thereof and a top plan view thereof. In FIG. 4B, the top plate shown in FIG. 4A is omitted.

The structure of the recording head shown in FIGS. 4A and 4B will be described. It comprises a base member 1 having walls 8, and a top plate 4 secured on the tops of the walls 8. By joining the base member and the top plate, both the liquid passages 12 and the common liquid chamber 10 are formed. The top plate 4 is provided with a supply opening 11 for supplying the ink, and the ink is supplied into the liquid passages 12 through the common liquid chamber 10 with which the liquid passages 12 communicates.

The base member 1 is provided with heaters 2, and for each of the heaters 2, a liquid passages is formed. The heater 2 has a heat generating resistor layer (not shown) and an electrode (not shown) electrically connected with the heat generating resistor layer. The heater 2 is energized through the electrode in accordance with the recording signal. Upon energization, the heater 2 generates thermal energy to supply the thermal energy to the ink supplied into the liquid. The thermal energy produces a bubble in the ink in accordance with the recording signal.

Another structure of the recording head usable with the present invention will now be described.

Figure 5A:
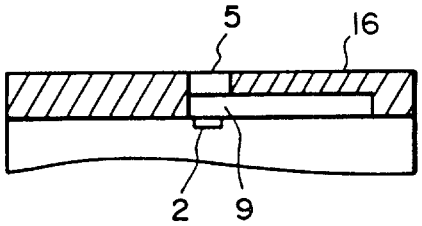
FIGS. 5A–B5 illustrate a recording head using the present invention.
Figure 5B:
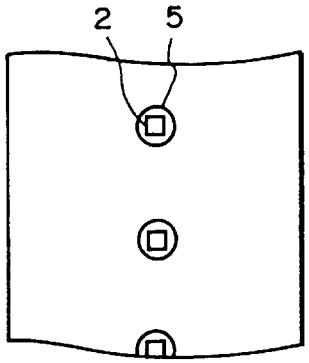
Figure 6A:
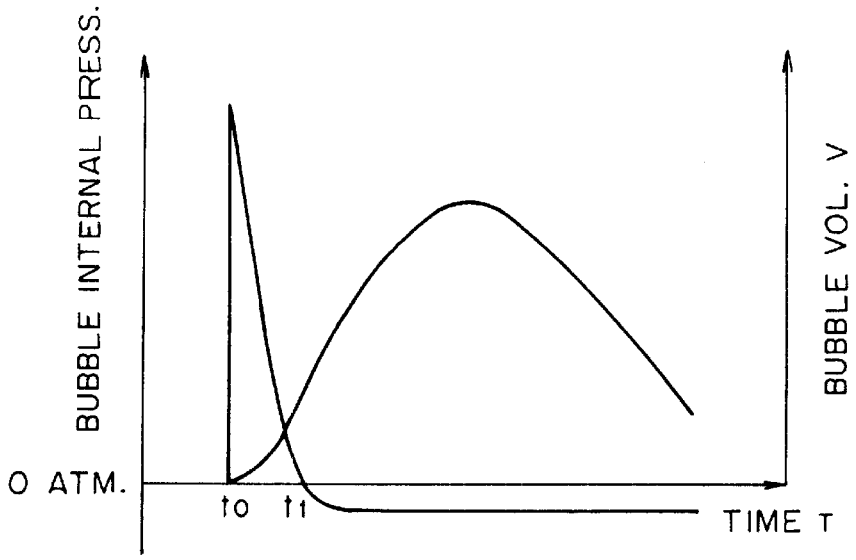
FIGS. 6A–6E illustrate bubble internal pressure and volume change in the present invention.
Figure 6B:
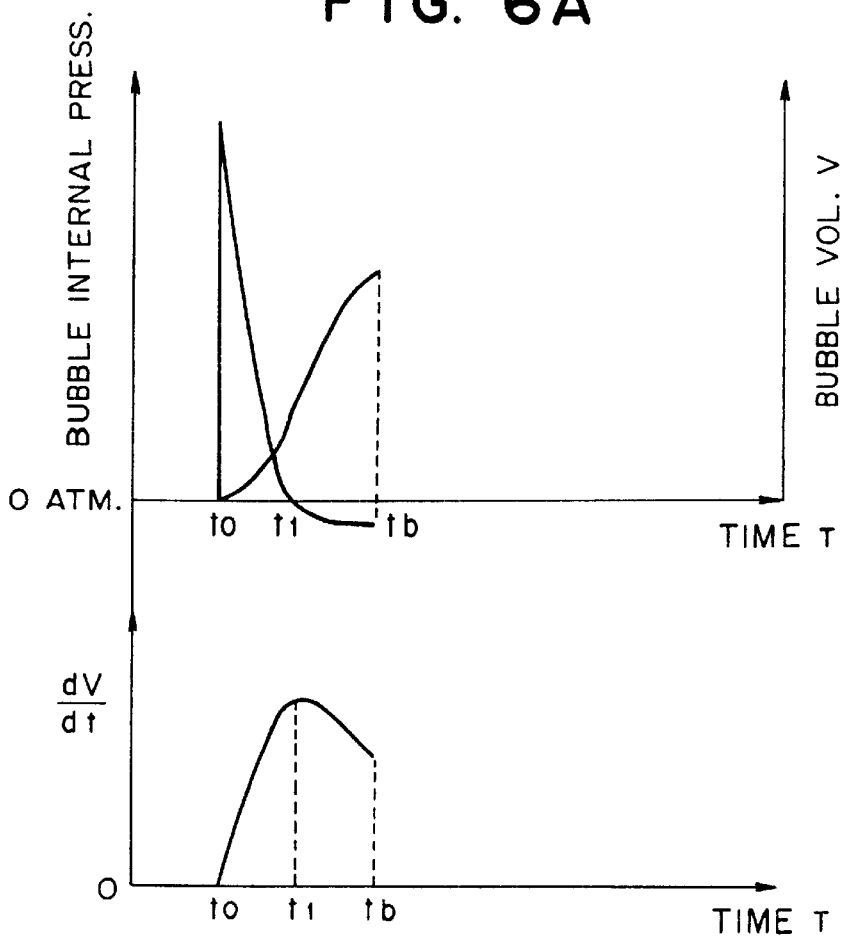
Figure 6C:
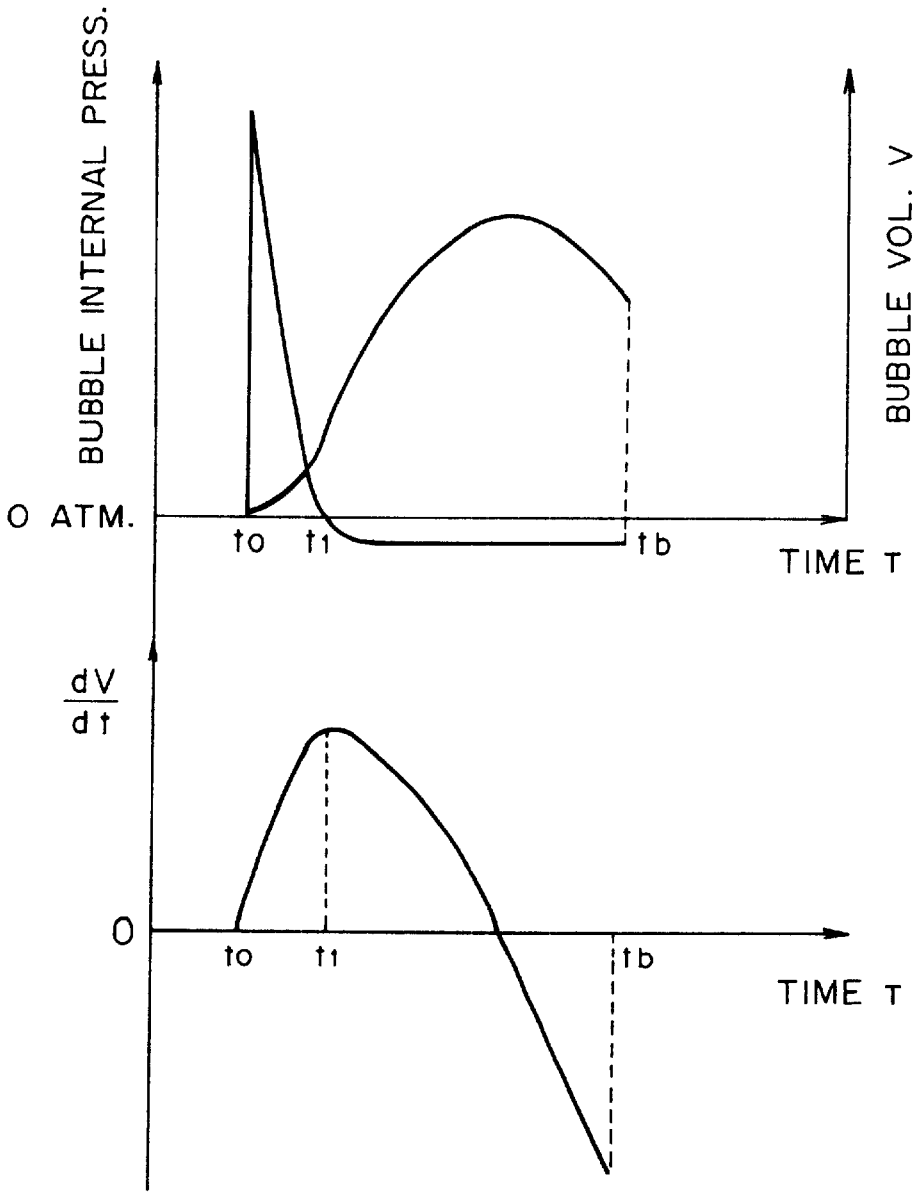
Figure 6D:
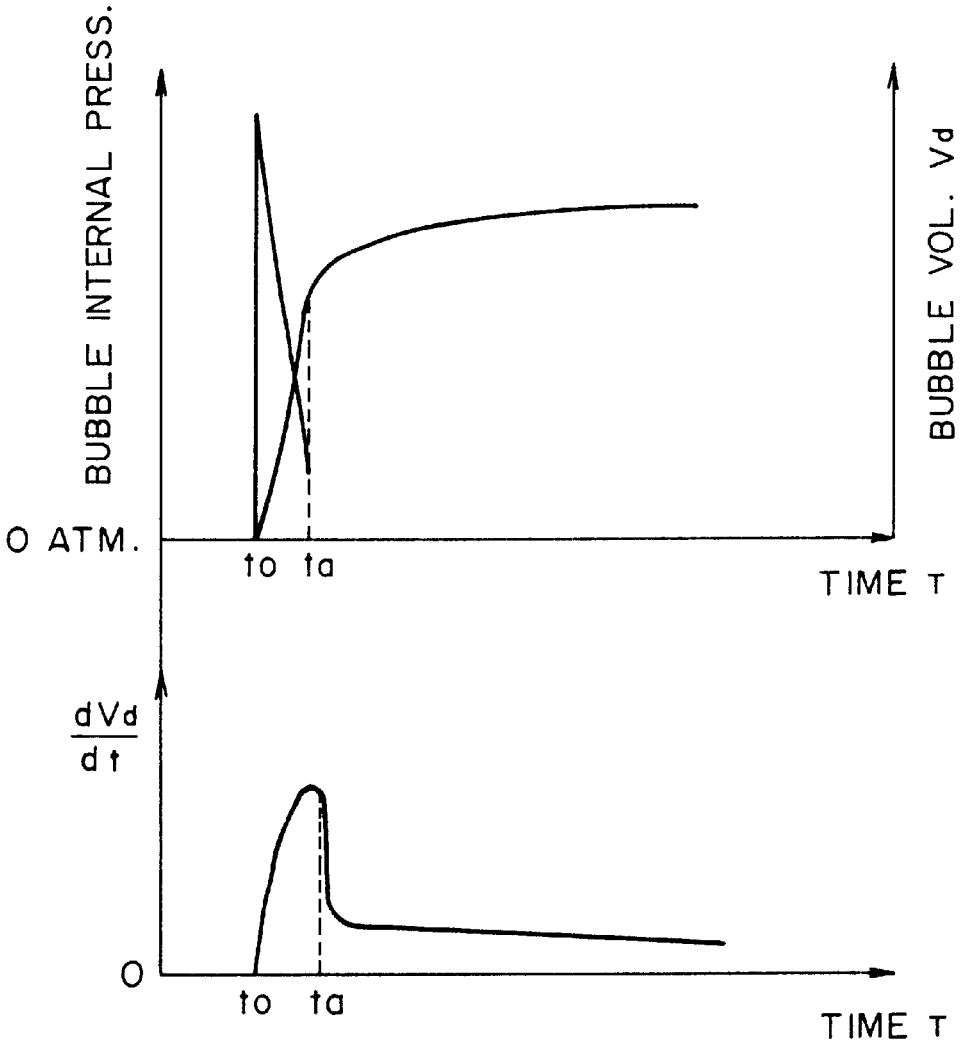
Figure 6E:
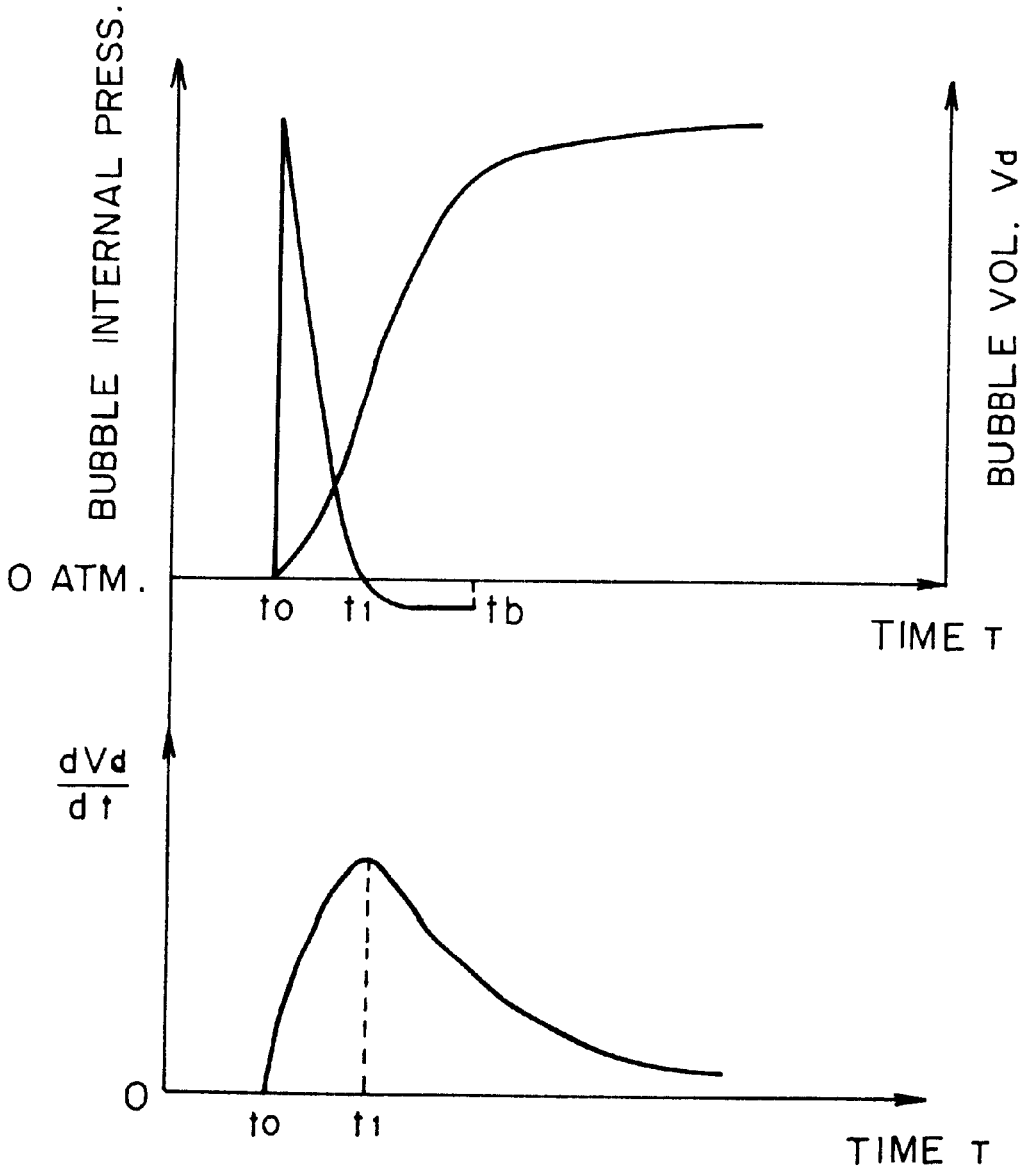
Figure 7A:
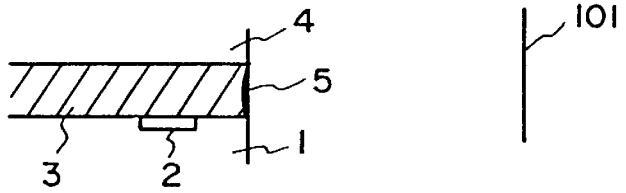
FIGS. 7(*a*)–7(*f*) illustrate ejection of the liquid.
Figure 7B:
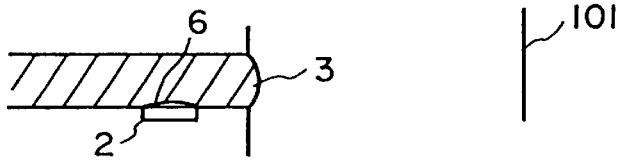
Figure 7C:
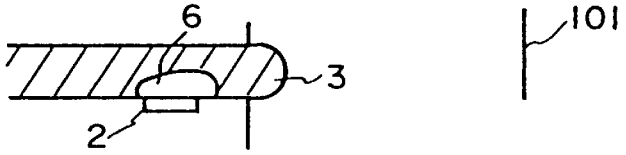
Figure 7D:
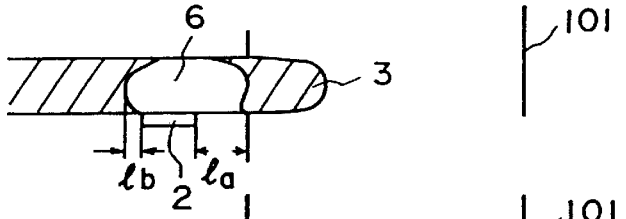
Figure 7E:
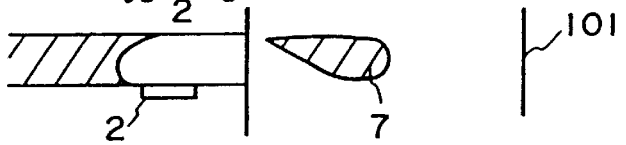
Figure 7F:
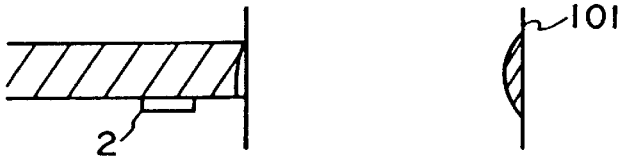

Referring to FIGS. 5A and 5B, there is shown a sectional view of the recording head and a top plan view. The difference of the recording head from the recording head shown in FIG. 5 is that the ink supplied into the liquid passage is ejected along or substantially along the liquid passage direction, whereas in FIGS. 5A and 5B, the ink is ejected at an angle from the ink passage (the ejection outlet is formed directly above the heater).

In FIGS. 5A and 5B, the same reference numerals as in FIGS. 4A and 4B are assigned to the elements having the corresponding functions.

In FIGS. 5A and 5B, the ejection outlets 5 are formed in an orifice plate 16, and it integrally has walls 9 between the ejection outlets 5.

FIGS. 6(*a*), 6(*b*), 6(*c*), 6(*d*) and 6(*e*) are graphs of bubble internal pressure vs. volume change over time in a first specific liquid jet method and apparatus suitably usable with the present invention.

This is summarized as follows:

(1) A liquid jet method wherein a bubble is produced by heating ink to eject at least a part of the ink by the bubble, and wherein the bubble communicates with the ambience under or not under the condition that the internal pressure of the bubble is not higher than the ambient pressure.

(2) A recording apparatus including a recording head having an ejection outlet through which at least a part of the ink is discharged by a bubble produced by heating the ink by an ejection energy generating means, a driving circuit for driving the ejection energy generating means so that the bubble communicates with the ambience under or not under the condition that the internal pressure of the bubble is not more than the ambient pressure, and a platen for supporting a recording material to face the ejection outlet.

According to the specific embodiment of the present invention, the volume and the speed of the discharged liquid droplets, so that the splash or mist which is attributable to the incapability of sufficiently high speed recording can be suppressed. Thereby, the contamination of the background of images can be prevented. When the present invention is embodied as an apparatus, the contamination of the apparatus can be prevented. The ejection efficiency is improved. The clogging of the ejection outlet or the passage can be prevented. The service life of the recording head is expanded with high quality of the print.

Referring to FIGS. 7(*a*)–7(*f*), the principle of liquid ejection will be described, before FIGS. 6A–6D are described. The liquid passage is constituted by a base 1, a top plate 4 and an unshown wall.

FIG. 7(*a*) shows the initial state in which the passage is filled with ink 3. The heater 2 (electro-thermal transducer, for example) is instantaneously supplied with electric current, the ink adjacent the heater 2 is abruptly heated by the pulse of the current, upon which a bubble 6 is produced on the heater 2 by so-called film boiling, and the bubble abruptly expands (FIG. 7(*b*)). The bubble continues to expand toward the ejection outlet 5, that is, in the direction of low inertia resistance. It further expands beyond the outlet 5 so that it communicates with the ambience (FIG. 7(*c*)). At this time, the ambience is in equilibrium with the inside of the bubble 6, or it enters the bubble 6.

The ink 3 pushed out by the bubble through the outlet 5 moves forward further by the momentum given by the expansion of the bubble, until it becomes an independent droplet and is deposited on a recording material 101 such as paper (FIG. 7(*d*)). The cavity produced adjacent the outlet 5 is supplied with the ink from behind by the surface tension of the ink 3 and by the wetting with the member defining the liquid passage, thus restoring the initial state (FIG. 7(*e*)). The recording medium 101 is fed to the position faced to the ink ejection outlet 5 on a platen by means of the platen, roller, belt or a suitable combination of them. As an alternative, the recording material 101 may be fixed, while the outlet (the recording head) is moved, or both of them may be moved to impart relative movement therebetween. What is required in the relative movement therebetween is to make the outlet face a desired position on the recording material.

In FIG. 7(*c*), in order that the gas does not move between the bubble 6 and the ambience, or the ambient gas or gases enter the bubble, at the time when the bubble 6 communicates with the ambience, it is desirable that the bubble communicate with the ambience under the condition that the pressure of the bubble is equal to or lower than the ambient pressure.

In order to satisfy the above, the bubble is made to communicate with the ambience in the period satisfying $t \leqq t1$ (t: time from bubble creation) in FIG. 6(*a*). Actually, however, the relation between the bubble internal pressure and the bubble volume over time is as shown in FIG. 6(*b*), because the ink is external by the expansion of the bubble. Thus, the bubble is made to communicate with the ambience in the time satisfying $t=tb$ ($t1 \leqq tb$) in FIG. 6, (*c*) (at t1, the internal pressure becomes equal to the external pressure).

The ejection of the droplet under this condition is preferable to the ejection with the bubble internal pressure higher than the ambient pressure (the gas ejects into the ambience), to avert the contamination of the recording paper or the inside of the apparatus due to the ink mist or splash. Additionally, the ink acquires sufficient energy, and therefore, a higher ejection speed, because the bubble communicates with the ambience only after the volume of the bubble increases.

In addition, it is further preferable to let the bubble communicate with the ambience under the condition that the bubble internal pressure is lower than the external pressure, since the above-described advantages are further enhanced.

The communication at lower pressure is effective to prevent the unstabilized liquid adjacent the outlet from splashing, which otherwise is liable to occur. In addition, the communication at lower pressure is advantageous in that the force, even if not large, is applied to the unstabilized liquid in the backward direction, by which the liquid ejection is further stabilized, and unnecessary liquid splashing can be suppressed.

The recording head has the heater 2 adjacent to the outlet 5. This is the easy arrangement to make the bubble communicate with the ambience. However, the above-described preferable condition is not satisfied by simply making the heater 2 close to the outlet. To satisfy it, the proper selections are made with respect to the amount of thermal energy (the structure, material, driving conditions, area or the like of the heater, the thermal capacity of the member supporting the heater, or the like), the nature of the ink, the various sizes of the recording head (the distance between the ejection outlet and the heater, the widths and heights of the outlet and the liquid passage).

As parameters for effectively embodying the communication ejection, there is a configuration of the liquid passage, as described hereinbefore. The width of the liquid passage is substantially determined by the configuration of the thermal energy generating element used. It has been found that the configuration of the liquid passage has a significant influence on the growth of the bubble, and that it is an effective factor.

In addition to the above-described condition, the communication condition can be controlled by changing the height of the liquid passage. To be less vulnerable to the ambient condition or the like and to be more stable, it is desirable that the height of the liquid passage be smaller than the width thereof ($H<W$).

It is also desirable that the communication between the bubble and the ambience occur when the bubble volume is not less than 70%, and more preferably, not less than 80%, of the maximum volume of the bubble or the maximum volume which will be reached before the bubble communicates with the ambience.

The description will now be made as to the method of measuring the relation between the bubble internal pressure and the ambient pressure. It is difficult to directly measure the pressure in the bubble and therefore, the pressure relation between them is determined in one or more of the following manner.

First, the description will be made as to the method of determining the rotation between the internal pressure and the ambient pressure on the basis of the measurements of the change, with time, of the bubble volume and the volume of the ink outside the outlet.

The volume V of the bubble is measured from the start of the bubble creation to the communication thereof with the ambience. Then, the second order differential $d^2V/dt^2$ is calculated, by which the relation (which is larger) between the internal pressure and the ambient pressure is known, because if $d^2V/dt^2>0$, the internal pressure of the bubble is higher than the external pressure, and if $d^2V/dt^2 \leqq 0$, the internal pressure is equal to or less than the external pressure. Referring to FIG. 6(*c*), from the time $t=t_0$ to the time $t=t_1$, the internal pressure is higher than the external pressure, and $d^2V/dt^2 \leqq 0$; from the time $t=t_1$ to the time $t=t_b$ (occurrence of communication), the internal pressure is equal to or less than the ambient pressure, and $d^2V/dt^2 \leqq 0$. Thus, by determining the second order differential of the volume V, ($d^2V/dt^2$), the higher one of the internal and external pressure is determined.

Here, it is required that the bubble can be observed directly or indirectly from the outside. In order to permit observance of the bubble externally, a part of the recording head is made of transparent material. Then, the creation, development or the like of the bubble is observed from the outside. If the recording head is of non-transparent material, a top plate or the like of the recording head may be replaced with a transparent plate. For better replacement from the standpoint of equivalency, the hardness, elasticity and the like of the replacement material and the material being replaced are as close as possible with each other.

If the top plate of the recording head is made of metal, non-transparent ceramic material or colored ceramic material, it may be replaced with transparent plastic resin material (transparent acrylic resin material) plate, glass plate or the like. The part of recording head to be replaced and the material to replace it are not limited to what has been described above.

In order to avoid differences in the nature of the bubble formation or the like due to differences in the nature of the materials, the replacement material preferably has a wetting nature relative to ink or other characteristics which are as close as possible to that of the material being replaced. Whether the bubble creation is the same or not may be confirmed by comparing the ejection speeds, the volumes of ejected liquid or the like before and after the replacement. If a suitable part of the recording head is made of transparent material, replacement is not required.

Even if any suitable part cannot be replaced with another material, it is possible to determine which of the internal pressure and the external pressure is larger, without replacement. This method will now be described.

In another method, in the period from the start of the bubble creation to the ejection of the ink, the volume Vd of the ink is measured, and the second order differential $d^2Vd/dt^2$ is obtained. Then, the relation between the internal pressure and the external pressure can be determined. More specifically, if $d^2Vd/dt^2>0$, the internal pressure of the bubble is higher than the external pressure, and if $d^2Vd/dt^2 \leqq 0$, the internal pressure is equal to or less than the external pressure. FIG. 6(*d*) shows the change, with time, of the first order differential dVd/dt of the volume of the ejected ink when the bubble communication occurs with the internal pressure higher than the external pressure. From the start of the bubble creation ($t=t_0$) to the communication of the bubble with the ambience (t=ta), the internal pressure of the bubble is higher than the external pressure, and $d^2Vd/dt^2>0$. FIG. 6(*e*) shows the change, with time, of the first order differential dVd/dt of the volume of the ejected ink when the bubble communication occurs with the internal pressure equal to or lower than the external pressure. From the start of the bubble creation ($t=t_0$) to the communication of the bubble with the ambience ($t=t_1$), the internal pressure of the bubble is higher than the external pressure, and $d^2vd/dt^2=0$. However, in the period from t=t1 to $t=t_b$, the bubble internal pressure is equal to or lower than the external pressure, and $d^2Vd/dt^2 \leqq 0$.

Thus, on the basis of the second order differential $d^2Vd/dt^2$, it can be determined which is higher the internal pressure or the external pressure.

The description will now be made as to the measurement of the volume Vd of the ink outside the ejection outlet. The configuration of the droplet at any time after the ejection can be determined on the basis of observation, by a microscope, of the ejecting droplet while it is illuminated with a light source such as stroboscope, LED or laser. The pulse light is emitted to the recording head driven at regular intervals, with synchronization therewith and with a predetermined delay. By doing so, the configuration of the bubble as seen in one direction at the time which is the predetermined period after the ejection, is determined. The pulse width of the pulse light is preferably as small as possible, provided that the quantity of the light is sufficient for observation, since then the configuration determination is accurate.

With this method, if the gas flow is observed in the external direction from the liquid passage at the instant when the bubble communicates with the ambience, it is understood that the communication occurs when the internal pressure of the bubble is higher than the ambient pressure. If the gas flow into the liquid passage is observed, it is understood that the communication occurs when the bubble internal pressure is lower than the ambient pressure.

As stated, the other preferable condition are that the bubble communicates with the ambience when the first order differentiation of the movement speed of an ejection outlet side end of the bubble is negative, as shown in FIG. 8, and that the bubble communicates with the ambience when $\mathbf{1}_a/\mathbf{1}_b \geqq 1$ is satisfied, where $\mathbf{1}_a$ is a distance between an ejection outlet side and of the ejection energy generating means and an ejection outlet side end of the bubble, and $\mathbf{1}_b$ is a distance between the end of the ejection energy generating means which is remote from the ejection outlet and the end of the bubble which is remote from the ejection outlet. It is further preferable that both of the above conditions are satisfied when the bubble communicates with the ambience.

Referring to FIGS. 7(*a*)–7(*f*), there is shown the growth of the bubble in a liquid jet method and apparatus according to a second example suitable to the present invention.

This is summarized as follows:

(3) A recording method using a recording head including an ejection outlet for ejecting ink, a liquid passage communicating with the ejection outlet and an ejection energy generating means for generating thermal energy contributable to ejection of the ink by creation of a bubble in the liquid passage, wherein the bubble communicates with the ambience when $\mathbf{1}_a/\mathbf{1}_b \geqq 1$ is satisfied, where $\mathbf{1}_a$ is a distance between an ejection outlet side end of the ejection energy generating means and an ejection outlet side end of the bubble, and $\mathbf{1}_b$ is a distance between the end of the ejection energy generating means which is remote from the ejection outlet and the end of the bubble which is remote from the ejection outlet.

(4) A recording apparatus including a recording head having an ejection outlet for ejecting ink, a liquid passage communicating with the ejection outlet and ejection energy generating means for generating thermal energy contributable to ejection of the ink by creation of a bubble in the liquid passage, a signal supply circuit for supplying a signal to the ejection energy generating means so that the bubble communicates with the ambience when $\mathbf{1}_a/\mathbf{1}_b \geqq 1$ is satisfied, where $\mathbf{1}_a$ is a distance between an ejection outlet side end of the ejection energy generating means and an ejection outset side end of the bubble, and $\mathbf{1}_b$ is a distance between the end of the ejection energy generating means which is remote from the ejection outlet and the end of the bubble which is remote from the ejection outlet, and a platen for supporting a recording material for reception of the liquid ejected.

FIG. 7(*a*) shows the initial state in which the passage is filled with ink 3. The heater 2 (electro-thermal transducer, for example) is instantaneously supplied with electric current, the ink adjacent the heater 2 is abruptly heated by the pulse of the current in the form of the driving signal from the driving circuit, upon which a bubble 6 is produced on the heater 2 by so-called film boiling, and the bubble abruptly expands (FIG. 7(*b*)). The bubble continues to expand toward the ejection outlet 5 (FIG. 7(*c*)), that is, in the direction of low inertia resistance. It further expands beyond the outlet 5 so that it communicates with the ambience (FIG. 7(*d*)). Here, the bubble 6 communicates with the ambience when $\mathbf{1}_a/\mathbf{1}_b \geqq 1$ is satisfied, where $\mathbf{1}_a$ is a distance from an ejection outlet side end of the heater 2 functioning as the ejection energy generating means and an ejection outlet side end of the bubble 6, and $\mathbf{1}_b$ is a distance from the end of the heater 2 remote from the ejection outlet and the end of the bubble 6 which is remote from the ejection outlet.

The ink 3 pushed out by the bubble through the outlet 5 moves forward further by the momentum given by the expansion of the bubble, until it becomes an independent droplet and is deposited on a recording material 101 such as paper (FIG. 7(*e*)). The cavity produced adjacent the outlet 5 is supplied with ink from behind by the surface tension of the ink 3 and by the wetting with the member defining the liquid passage, thus restoring the initial states (FIG. 7(*f*)). The recording medium 101 is fed to a position facing the ink ejection outlet 5 on a platen by means of the platen, roller, belt or a suitable combination of them. As an alternative, the recording material 101 may be fixed, while the outlet (the recording head) is moved, or both of them may be moved to impart relative movement therebetween, what is required in the relative movement therebetween is to make the outlet face a desired position on the recording material.

If the liquid is ejected in accordance with the principle described above, the volume of the liquid ejected through the ejection outlet is constant at all times, since the bubble communicates with the ambience. In this way, a high quality image can be produced without non-uniformity of the image density.

Since the bubble communicates with the ambience under the condition of $\mathbf{1}a/\mathbf{1}b \geqq 1$, the kinetic energy of the bubble can be efficiently transmitted to the ink, so that the ejection efficiency is improved.

Furthermore, when the liquid is ejected under the above-described conditions, the time required for the cavity produced adjacent to the ejection outlet after the liquid is ejected to be filled with new ink, can be reduced as compared with the case in which $\mathbf{1}a/\mathbf{1}b<1$, and therefore, the recording speed is further improved.

The description will now be made as to the method of measuring the distances $\mathbf{1}_a$ and $\mathbf{1}_b$ when the bubble communicates with the ambience under the second condition. For example, in the case of the recording head shown in FIGS. 7(*a*)–7(*f*), the top plate 4 is made of a transparent glass plate. The recording head is illuminated from above by a light source capable of pulsewise light emission such as stroboscope, laser or LED. The recording head is observed through a microscope.

More particularly, the pulsewise light source is turned on and off in synchronism with the driving pulses applied to the heater, and the behavior from the creation of the hubble to the ejection of the liquid is observed, using the microscope and camera. Then, the distances $\mathbf{1}_a$ and $\mathbf{1}_b$ are determined.

The width of the liquid passage is substantially determined by the configuration of the thermal energy generating element used, but it is determined on the basis of a rule of thumb. However, it has been found that the configuration of the liquid passage has a significant influence on the growth of the bubble, and that it is an effective factor for achieving the above condition of the thermal energy generating element in the passage in the second specific embodiment.

Using the height of the liquid passage, the growth of the bubble may be controlled so as to satisfy $\mathbf{1}_a/\mathbf{1}_b \geqq 1$, preferably $\mathbf{1}_a/\mathbf{1}_b \geqq 2$, and further preferably $\mathbf{1}_a/\mathbf{1}_b \geqq 4$. It has been found that the liquid passage height H should be smaller than at least the liquid passage width W (H<W), since then the recording operation is less influenced by the ambient condition or another, and therefore, the operation is stabilized. This is because the communication between the bubble and the ambience occurs by the bubble having an increased growing speed in the interface at the ceiling of the liquid passage, so that the influence of the internal wall on the liquid ejection can be reduced, thus further stabilizing the ejection direction and speed. In the second specific embodiment, it has been found that $H \leqq 0.8$ W is preferable since then the ejection performance does not change, and therefore, the ejection is stabilized even if the high speed ejection is performed for a long period of time.

Furthermore, by satisfying $H \leqq 0.65$ W, a highly accurate deposition performance can be provided even if the recording ejection is quite greatly changed by carrying different recording information.

It is further preferable in addition to the above conditions that the first order differential of the moving speed of the ejection outlet side end of the bubble be negative, when the bubble communicates with the ambience.

Referring to FIG. 8, there is shown the change, with time, of the internal pressure and the volume of the bubble in a liquid jet method and apparatus according to a third example suitable to the present invention. The third specific embodiment is summarized as follows:

(5) A liquid jet method using a recording head having an ejection outlet for ejecting ink, a liquid passage communicating with the ejection outlet and an ejection energy generating element for generating thermal energy contributable to the ejection of the ink by creation of a bubble in the liquid passage, wherein a first order differential of a movement speed of an ejection outlet side end of the created bubble is negative, when the bubble created by the ejection energy generating means communicates with the ambience through the ejection outlet.

(6) A liquid jet apparatus comprising a recording head having an ejection outlet for ejecting ink, a liquid passage communicating with the ejection outlet and an ejection energy generating element for generating thermal energy contributable to the ejection of the ink by creation of a bubble in the liquid passage, a signal supply circuit for supplying a signal to the ejection energy generating means so that a first order differential of a movement speed of an ejection outlet side end of the crested bubble is negative, when the bubble created by the ejection energy generating means communicates with the ambience through the ejection outlet, and a platen for supporting a recording material for reception of the liquid ejected.

The third example provides a solution to the problem solved by the first example, by a different method. The major problem underlying this third example is that the ink existing adjacent the communicating portion between the bubble and the ambience is over-accelerated with the result that the ink existing there is separated from the major part of the ink droplet. If this separation occurs, the ink adjacent thereto is splashed, or is scattered into mist.

In addition, where the ejection outlets are arranged at a high density, improper ejection will occur by the deposition of such ink. The third specific embodiment is based on the finding that the drawbacks are attributable to the acceleration.

More particularly, it has been found that the problems arise when the first order differential of the moving speed of the ejection outlet side end of the bubble is positive when the bubble communicates with the ambience.

Figure 8A:
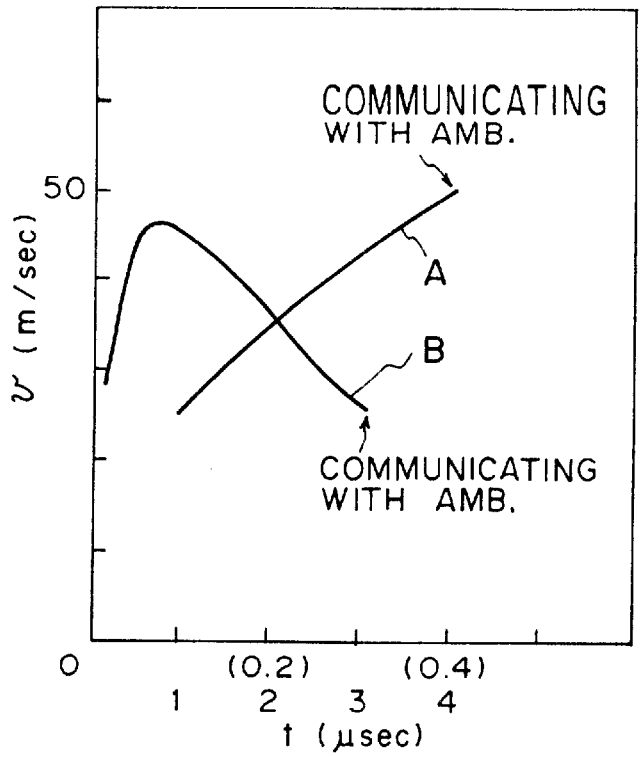
FIGS. 8A and 8B illustrate liquid ejection method used in the present invention.
Figure 8B:
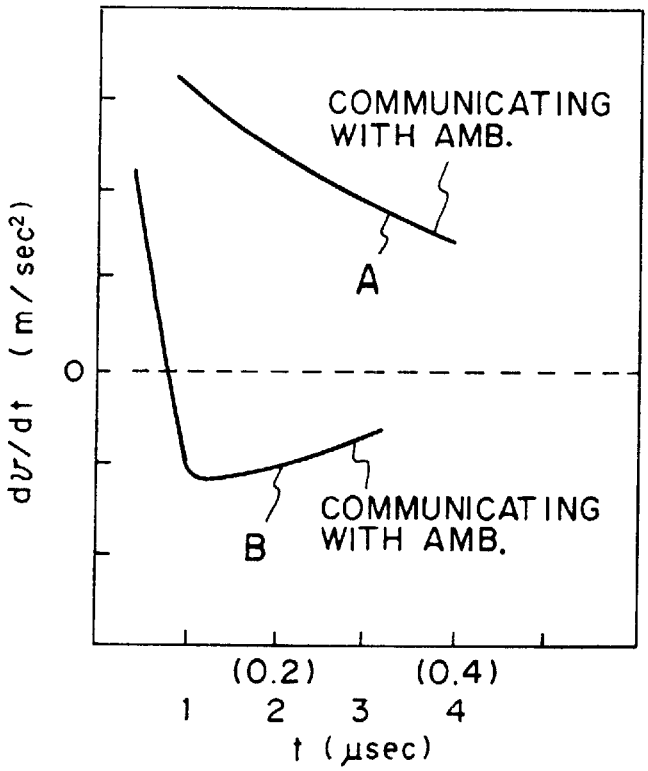
Figure 9:
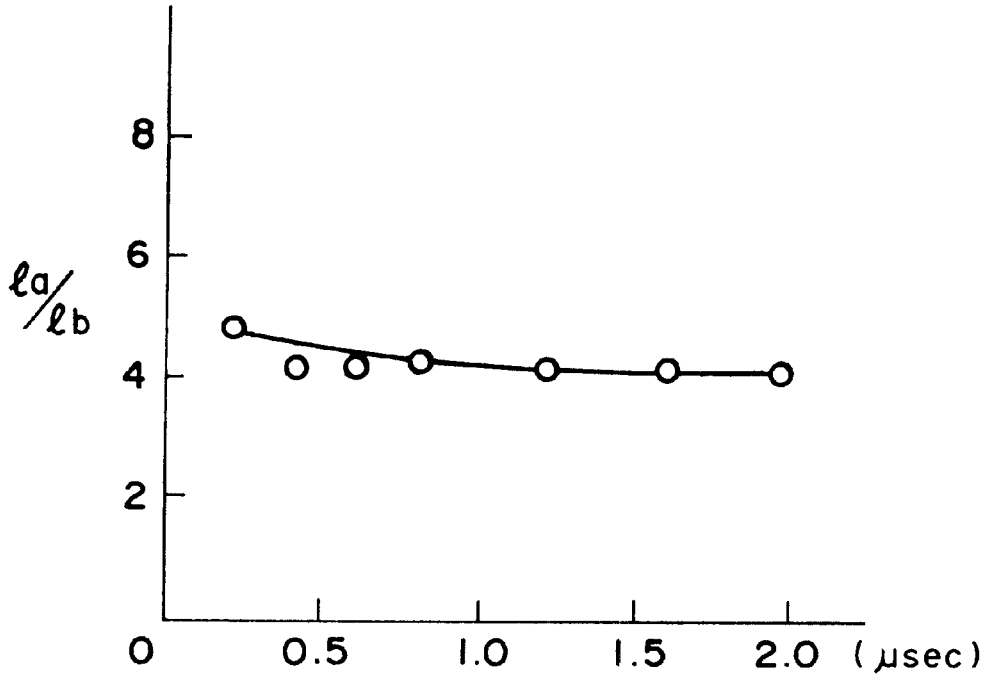
FIG. 9 is a graph showing the change of a front to end ratio 1*a*/1*b* of a bubble.

FIG. 8 illustrates graphs of the first order differential and the second order differential (the first order differential of the moving speed) of the displacement of the ejection outlet side end of the bubble from the ejection outlet side end of the heater until the bubble communicates with the ambience. It will be understood that the above-discussed problems arise in the case of a curve A in FIGS. 8A and 8B, where the first order differential of the moving speed of the ejection outlet side end of the bubble is positive.

Curves B in FIGS. 8A and 8B represent the third example or condition using the concept of FIGS. 7(*a*)–7(*b*). The created bubble communicates with the ambience under the condition that the first order differential of the moving speed of the ejection outlet side end of the bubble is negative. By doing so, the volumes of the liquid droplets are stabilized, so that high quality images can be recorded without ink mist or splashing and the resulting paper and apparatus contamination.

Additionally, since the kinetic energy of the bubble can be sufficiently transmitted to the ink, the ejection efficiency is improved so that the clogging of the nozzle can be avoided. The droplet ejection speed is increased, so that the ejection direction can be stabilized, and the required clearance between the recording head and the recording paper can be increased so that the designing of the apparatus is made easier.

The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed, in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can thereby be affected instantaneously, and therefore, the liquid (ink) is ejected with quick response.

The present invention is effectively applicable to a so-called full-line type recording head having a length corresponding to the maximum recording width. Such a recording head may comprise a single recording head or plural recording heads combined to cover the maximum width.

In addition, the present invention is applicable to a serial type recording head wherein the recording head is fixed on the main assembly, to a replaceable chip type recording head which is connected electrically with the main apparatus and can be supplied with ink when it is mounted in the main assembly, or to a cartridge type recording head having an integral ink container.

Provision of recovery means and/or auxiliary means for preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording heads mountable, they may be single heads corresponding to a single color ink, or plural heads corresponding to a plurality of ink materials having different recording colors or densities. The present invention is effectively applicable to an apparatus having at least one of a monochromatic mode mainly with black, a multi-color mode with different color ink materials and/or a full-color mode using a mixture of the colors, which may be an integrally formed recording unit or a combination of plural recording heads.

The description will now be made as to the method of determining the moving speed of the ejection outlet side end of the bubble and the first order differential of the moving speed.

The position of the ejection outlet side end of the bubble at the respective times after the start of bubble creation can be observed by a microscope wherein the bubble is illuminated from the top or side with pulse light such as a stroboscope (LED) or laser. More particularly, FIGS. 10A-1 through 10A-10 and 10B-1 through 10B-4, wherein the ejection process is shown, shows the change, with time, of the displacement $x_{b-h}$ of the ejection outlet side end of the bubble from the ejection side end of the heater, from the start of bubble creation to the communication of the bubble with the ambience. On the basis of measurements, a first order differential $dx_{b-h}/dt$ of the displacement is obtained, by which the moving speed vx of the ejection outlet side end of the bubble is obtained. Then, the first older differential dvx/dt of the moving speed (the second order differential $d^2x_{b-h}/d^2t$ of the displacement) can be obtained.

Here, it is required that the bubble can be observed directly or indirectly from the outside. In order to permit observance of the bubble externally, a part of the recording head is made of transparent material. Then, the creation, development or the like of the bubble-is observed from the outside. If the recording head is of non-transparent material, a top plate or the like of the recording head may be replaced with a transparent plate. For better replacement from the standpoint of equivalency, the hardness, elasticity and the like of the replacement material and the material being replaced are preferably as close as possible with each other.

If the plate of the recording head is made of metal, non-transparent ceramic material or colored ceramic material, it may be replaced with transparent plastic resin material (transparent acrylic resin material) plate, glass plate or the like. The part of recording head to be replaced and the material to replace it are not limited to what has been described above.

In order to avoid differences in the nature of the bubble formation or the like due to the differences in the nature of the materials, the replacement material preferably has a wetting nature relative to the ink or other characteristics which are as close as possible to those of the material being replaced. Whether the bubble creation is the same or not may be confirmed by comparing the ejection speeds, the volumes of the ejected liquid or the like before and after the replacement. If a suitable part of the recording head is made of transparent material, replacement is not required.

Another embodiment of the present invention will be described in which higher ejection properties and higher frequency are possible with stabilized ink ejection in a recording method, recording apparatus and recording head using the communication ejection system. In order to accomplish the purpose, this embodiment improves the restoration of the meniscus back to the ejection outlet position.

Figure 11:
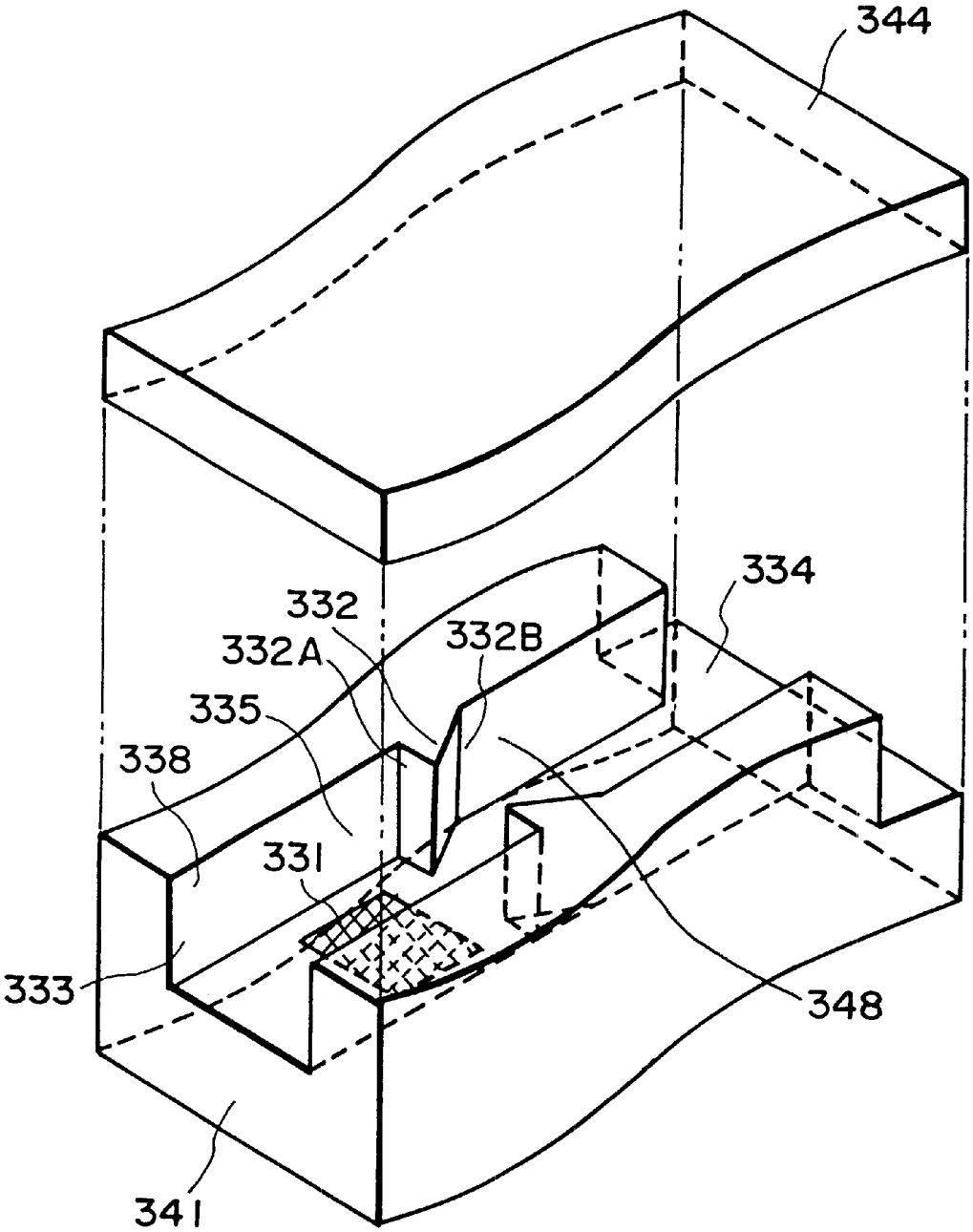
FIG. 11 shows a recording head according to an embodiment of the present invention.
Figure 12A:
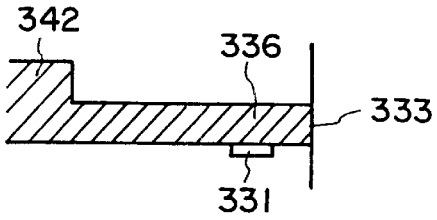
FIGS. 12(*a*)–12(*f*) illustrate the recording method in the apparatus of FIG. 11.
Figure 12B:
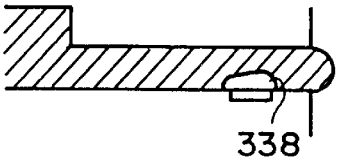
Figure 12C:
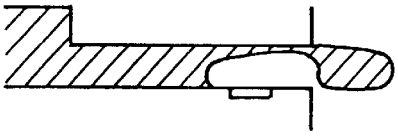
Figure 12D:
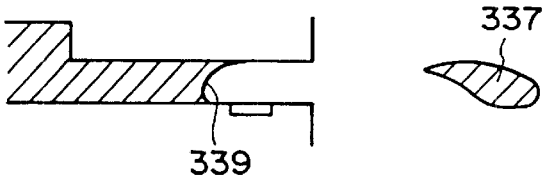
Figure 12E:
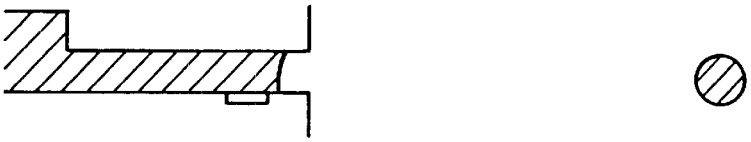
Figure 12F:
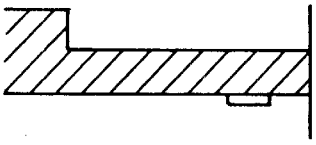
Figure 16A:
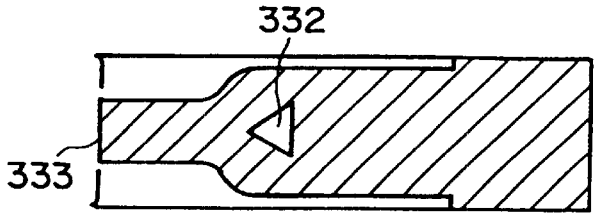
FIGS. 16(*a*)–16(*e*) illustrate the bubble behavior from the initial state to the completion of refilling.
Figure 16B:
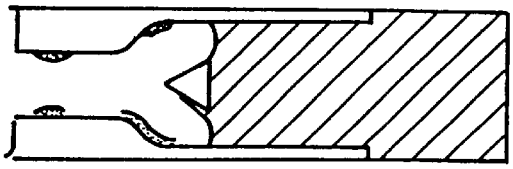
Figure 16C:
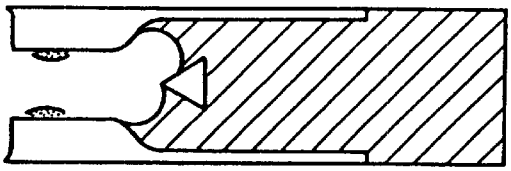
Figure 16D:
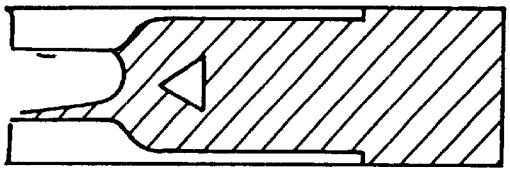
Figure 16E:
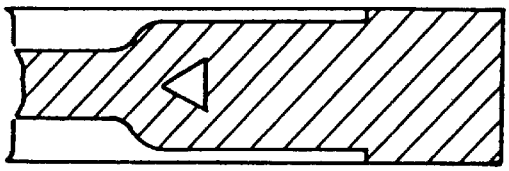

Referring to FIG. 11, this embodiment will be described. FIG. 11 shows a major part of an ink jet recording head according to this embodiment. The recording head-comprises energy generating means for generating energy contributable to the ejection of the ink. The energy generating means is in the form of a heat generating element such as an electrothermal transducer for producing thermal energy creating film boiling in the ink upon the supply of electric power. The heat generating element is mounted on a base member 341. The heat acting portion (heater) 331 above the heat generating element applies thermal energy to the ink in the liquid passage 335 defined by the wall 348. The recording head of this embodiment is provided on the wall 348 between the heater 331 and a liquid chamber 334 with a reducing portion 332A for steeply reducing the cross-sectional area of the liquid passage and a diverging portion 332B for increasing the cross-sectional area of the passage toward the liquid chamber. The reducing portion 332A and the diverging portion 332B constitute a throat 344. Designated by 342 is a top plate.

FIGS. 12(*a*)–12(*f*) show the ink jet recording process using the recording head of FIG. 11. In FIGS. 12(*a*) to 12(*e*), reference numerals 336, 338 and 337 designate ink, bubble and droplet, respectively.

FIG. 12(*a*) shows an initial state in which the liquid passage is filled with the ink 336. By instantaneously applying electric current to the electrothermal transducer, for example, the ink 336 adjacent the heater 331 is steeply heated pulsewisely. This causes film boiling of the ink to create a bubble 338 on the heater 331, and the bubble quickly expands (FIG. 12(*b*)). The bubble 338 further expands mainly toward the ejection outlet 5 side, to which the resistance inertia is small. The expansion exceeds the ejection outlet 333, so that the bubble 338 is brought into communication with the ambience (FIG. 12(*c*)). At this time, the ambient pressure is equivalent or higher than the bubble 338 internal pressure, and therefore, the external air is introduced into the bubble 338. The ink 336 discharged through the ejection outlet 333 continues to move away from the ejection outlet due to the momentum given by the expansion of the bubble 338. It becomes an independent liquid droplet 337 and is directed to a recording material such as paper. The ink in the passage, on the other hand, constitutes a meniscus 339 because the ink front is retracted beyond the heater 331 toward the liquid chamber 342 (FIG. 12(*d*)). Into the space formed by the liquid ejection, adjacent the ejection outlet 333, the ink 336 is supplied toward the right in the figure due to the surface tension of the rear ink 336 and the wetting by the liquid of the member constituting the liquid passage surface. Therefore, the meniscus 337 returns toward the ejection outlet 333 (liquid refilling) (FIG. 12(*e*)). When the meniscus returns completely to the ejection outlet 333 and the initial state is established, the next ejection is enabled (FIG. 12(*f*)).

Referring back to the state of FIG. 12(*c*), when the bubble 338 communicates with the ambience, the ambient air flows into the bubble. During this state, the above-described four conditions are preferable. For example, it the communication between the bubble and the ambience is established under the condition that the internal pressure of the bubble is equal to or lower than the ambient pressure, the adverse affect of the splashing of the gas from the bubble into the ambience will occur. Here, if the bubble 338 is efficiently communicated with the ambience through the ejection outlet 333, the speed of the ejected liquid droplet is increased, and in addition, the ink clogging or the like can be effectively prevented. In addition, the inconvenience of the introduction of air into the liquid passage, with the possible result of ejection failure, can be prevented.

The flow resistance element, that is, the throat 332 shown in FIG. 11, functions first to permit efficient communication between the bubble and the ambience. In FIG. 12(*b*), the bubble 338 is produced by the film boiling and expands toward the ejection outlet side because the inertia resistance is smaller in that direction than toward the liquid chamber. The flow resistance against the liquid flow toward the liquid chamber is provided by the throat 332, and therefore, the expansion of the bubble 338 toward the liquid chamber is further obstructed, and therefore, the expansion toward the ejection side is promoted. As a result, the bubble 338 more efficiently communicates with the ambience. This is effective to stabilize the ink ejection, increase the ejection speed and improve the ejection properties.

The restoration of the meniscus 9 (FIGS. 12(*d*)–12(*f*)) is controlled by the surface tension force of the ink and the wetting force between the ink and the nozzle internal surface. More particularly, during the meniscus restoration, the meniscus surface is curved, so that the meniscus is restored by the surface tension force tending to minimize the meniscus surface area and the wetting force between the nozzle internal wall and the ink tending to maintain the smaller contact angle.

The meniscus restoration speed (ink refilling speed) is preferably as high as possible, since then the ejection frequency can be increased.

The flow resistance element preferably does not prevent the ink refilling action, and it is preferable that the flow resistance element increases the refilling speed. Then, the ejection is further stabilized, the ejection frequency can be further increased, and the ejection efficiency can be further improved, due to the combined effect with the communication ejection system.

The forces controlling the ink refilling action, are dependent on the nature of the ink and the material of the nozzle internal wall. The conventional methods for increasing the refilling speed include only non-active methods such as decreasing the flow resistance of the nozzle, rather than by improvement of the materials.

Various experiments and investigations have revealed means for positively increasing the ink refilling speed. The principle of the increase of the refilling speed will now be described.

FIG. 13 is a top plan view of the recording head of FIG. 11, as seen from the top plate 344 side. The state shown therein corresponds to the state of FIG. 12(*d*). It has been found by the inventors that when the meniscus 339 retracts the most, the meniscus 339 projects toward the liquid chamber 334 beyond the throat 332. As shown in FIG. 13, the shape of the meniscus is characterized in that the radius of curvature of the portion projecting beyond the throat 332 is smaller than when there is no throat. The restoration force of the portion projected beyond the throat 332 is controlled substantially only by the surface tension of the ink, since the ink is not apart from the internal nozzle wall. Since the surface tension is produced so as to minimize the surface area of the meniscus, the restoration force is large if the radius of curvature is small. For this reason, the meniscus is quickly restored in this state.

The provision of the throat promotes the ink to remain on the nozzle internal wall, and therefore, the refilling by the advancement of the contact line between the ink and the nozzle internal wall by the wetting, can be controlled.

In FIG. 11, the element for reducing the cross-sectional area of the passage is provided only by the wall defining the liquid passage. But it may be provided on the top plate or on the nozzle internal wall having the heater substrate, or it may be provided in the liquid passage. The smallest cross-sectional area of the liquid passage at the throat is preferably 30–90% of the cross-sectional area of the liquid passage at the portion where the heater 331 is provided. If cross-sectional area at the throat is large, the effect thereof becomes smaller. If it is too small, the refilling speed may decrease due to the increase of the flow resistance thereby.

FIGS. 14(*a*)–14(*b*) show examples of the throat structure.

FIGS. 15(*a*) and 15(*b*) also show examples of the throat structure functioning as the flow resistance element usable with the present invention. As will be understood, there are provided triangular throat portions 332 having different configurations. When the ink flow speed toward the liquid chamber due to the expansion of the bubble and the retraction of the meniscus increases, larger eddies are produced at the liquid chamber side in FIG. 15(*a*) than in FIG. 15(*b*), as will be understood from the flow lines shown therein, and therefore, the flow resistance is larger toward the liquid chamber than toward the ejection outlet. Therefore, the configuration of FIG. 15(*a*) more efficiently retards the bubble expansion toward the liquid chamber, and the meniscus retraction distance in FIG. 15(*b*) is smaller. The meniscus restoration force is determined by the circumferential length of the portion which confines the meniscus (the minimum cross-sectional area portion when the meniscus is at a liquid chamber side beyond the minimum cross-sectional area portion, and ejection outlet if it is at the ejection outlet side), but it is not influenced by the distance of the meniscus retraction from the ejection outlet. In other words, if the configuration of the opening of the minimum cross-sectional area portion is the same, the restoration force is the same irrespective of the configurations before or after it. Therefore, it is preferable that the meniscus projects beyond the minimum cross-sectional area portion toward the liquid chamber side, but the refilling time is shorter if the distance of projection is smaller.

If the comparison is made between the configurations of the throats of FIGS. 15(*a*) and 15(*b*), the communication ejection efficiency is higher, and the refilling time is shorter, in the case of FIG. 15(*a*) than in the case of FIG. 15(*b*). The same applies when the comparison is made between FIG. 14(*b*) and FIG. 13. However, the configuration, dimension or the like of the flow resistance element can be properly selected by one skilled in the art depending on the ejection property desired for the recording head, the nature of the ink or the like.

FIGS. 16(*a*)–16(*e*) show the results of experiments of ink ejection for every 20 μsec from the initial state (FIG. 15(*a*)) when the flow resistance element, that is, the throat 332 as shown in FIG. 15(*a*) is used. As will be understood from FIG. 15(*b*), the throat 332 works effectively for the communication ejection and the subsequent meniscus retraction. It has been confirmed that the refilling is almost completed after 80 sec through the refilling action shown by FIGS. 16(*c*) and 16(*d*).

As will be understood from the foregoing, it has been found that by provision of a throat at the proper position, the radius of curvature of the meniscus can be reduced, and as a result, the refilling speed can be increased. The investigations have been further made as to the recording head structure capable of extending the meniscus beyond the throat toward the liquid chamber. As a result, it has been found that the conditions, $L1<2\times L2$ and $L3<10\times L2$, are more preferable since then the refilling speed is increased irrespective of the material of the ink and the material of the nozzle wall, where L1 is a distance between the minimum cross-sectional area position of the throat and the portion of the heater 331 closest to the liquid chamber, measured along the liquid passage, L2 is a distance between the ejection outlet and the portion of the heater 331 closest to the ejection outlet, measured along the liquid passage, and L3 is a distance between the portion of the heater 331 closest to the liquid chamber 34 and the liquid chamber 34.

It is satisfactory if the minimum cross-sectional area satisfies the above conditions, and the front and rear configuration of the tapered portions may be not influential, they may be curved.

Figure 17:
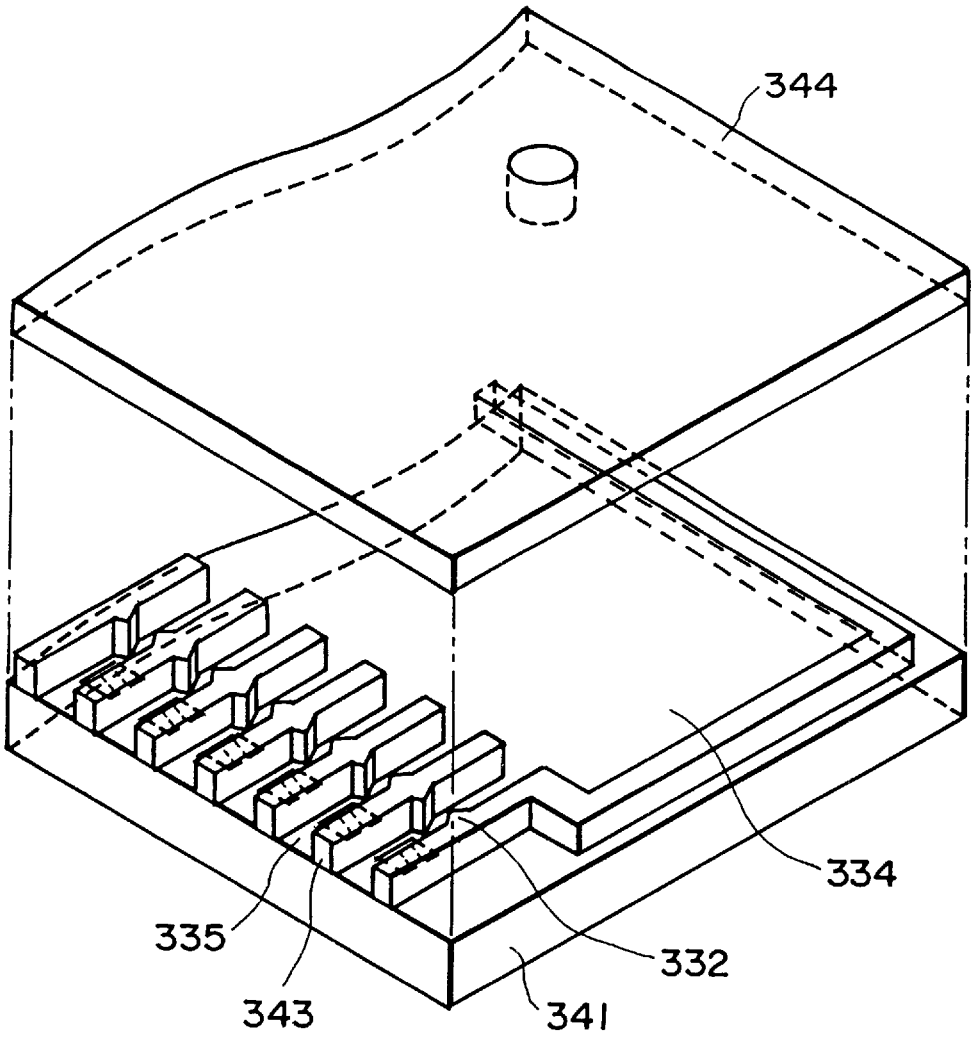
FIG. 17 is a perspective view of a recording head.
Figure 18:
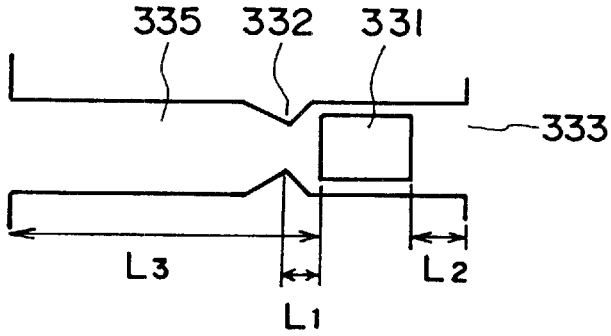
FIG. 18 shows a major part of the recording head.

FIG. 17 shows the structure of the recording head, and FIG. 18 is a top plan view of the structure adjacent the ejection outlet, as seen from the top plate side. The recording head comprises a partition wall 343 for separating the liquid passages 335 on the heater base plate 334, a transparent top plate 344 (glass) contacted to the partition walls 343, and a heater 331 on the base plate 341 in the liquid passage. The electrothermal transducer element corresponding to the heater 331 is supplied with electric power through unshown electrodes in accordance with image signals. The structure adjacent the ejection outlet 333 is such that the throat providing structure is not used on the base plate 341 and the top plate 344 facing the base plate 341. A pair of throat providing structures are provided on the side walls. FIG. 18 shows the detailed structure for providing the throat. The design value of the distance (L1) from the heater 331 to the minimum cross-sectional area position of the throat 332 is 15 μm; the design value of the distance (L2) from the ejection outlet 333 to the front edge of the heater 331; and the design value of the distance (L3) from the heater 331 to the liquid chamber 334 is 150 μm. The minimum cross-sectional area of the throat 332 has a width of approximately 20 μm, which is 50% of the cross-sectional area of the liquid passage at the heater 331 portion. The liquid passage diverges from the minimum portion for 20 μm toward the liquid chamber, and diverges for 10 μm toward the ejection direction. The height of the liquid passage is constant (25 μm), and the width of the liquid passage is 40 μm, other than the throat providing portion. The heater 331 has a width of 32 μm and a length of 40 μm. One recording head is provided with 48 such liquid passages with a pitch of 63.5 μm. The recording head satisfies the condition disclosed in U.S. Ser. No. 692,935 in which the bubble creates by the heater communicates with the ambience under the condition that the bubble internal pressure is lower than the ambient pressure. In addition, it satisfies the conditions of this invention.

The description will now be made as to the manufacturing method of the recording head. A heater base plate 341 is manufactured by forming on a silicon wafer heaters at regular intervals, electrodes, protection film or the like, through a known semiconductor manufacturing process. A dry film is bonded onto the heater base plate 341, and the dry film is exposed to exposure light through a mask having a pattern providing the throat structures. The dry film is developed, and thus, the partition walls 343 are formed. In addition, a top plate 344 made of glass is bonded thereon. Subsequently, a dicing saw is used to provide recording head chips. To the chip, an electric circuit and an ink supply tube or the like are connected. The ink was produced as follows:

| | |
|---|---|
| C.I. Hood Black 2 | 3.0% by weight |
| Diethylene glycol | 15.0% by weight |
| N-methyl-2-pyrrolidone | 5.0% by weight |
| Ion exchanger water | 77.0 by weight |

The above are stirred in a container into a uniform mixture. Thereafter, the mixture is filtered using a polyfluoroethylene fiber filter having pores of 0.45 μm. The ink thus formed had the viscosity of 2.0 cps (20° C.). A pulse signal having a voltage of 9 V and a width of 2.5 μm was applied. When the driving frequency was gradually increased, it was found that the ink was stably ejected until the frequency reaches 18 kHz. When the printing operation was effected on a recording sheet, stabilized high quality images could be provided.

A transparent ink which is the same as the above-described ink but not containing the C.I. Hood Black was supplied, and the ink in the nozzle was observed by a microscope while the ink was illuminated from the top plate side. It was confirmed that the bubble created at the heater communicates with the ejection outlet, and bubble collapse was not observed. Furthermore, when the meniscus retracted to the maximum extent, it was confirmed that the part of the meniscus which is closest to the liquid chamber is beyond the minimum cross-sectional area position of the throat 332 toward the liquid chamber 334.

Figure 19A:
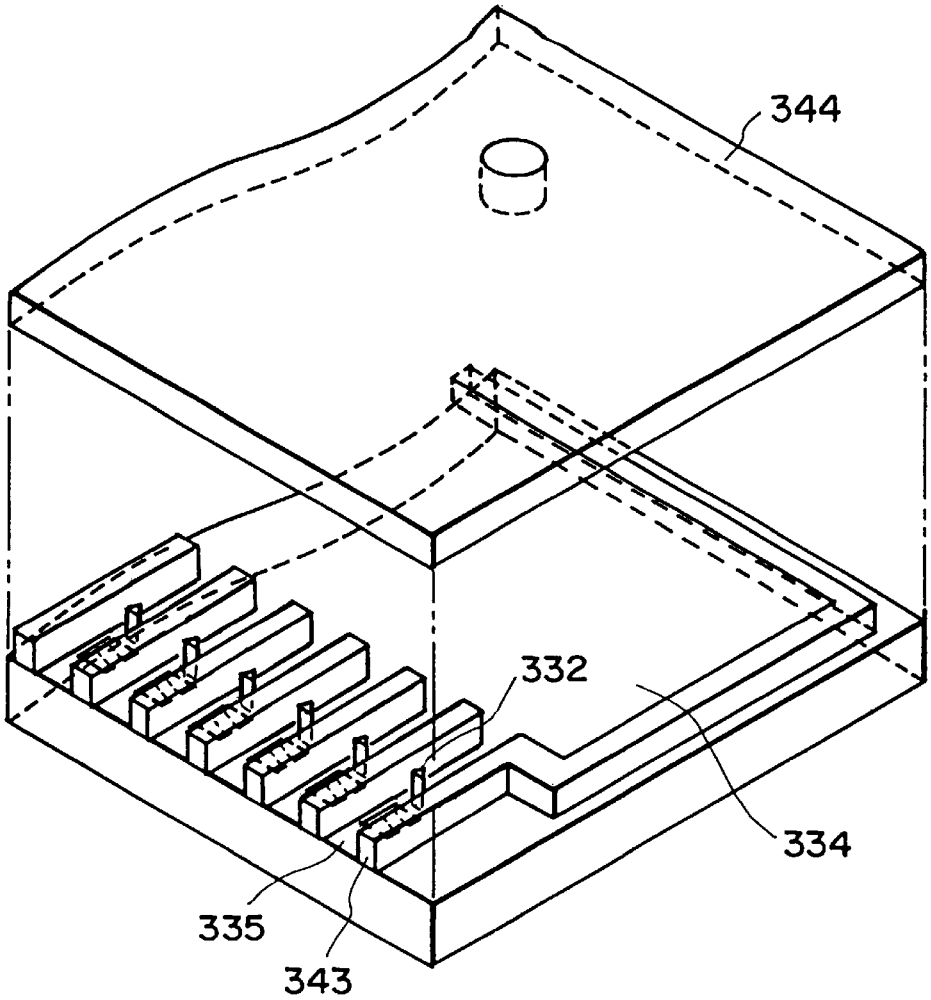
FIGS. 19A and 19B are perspective views of a recording head.
Figure 19B:
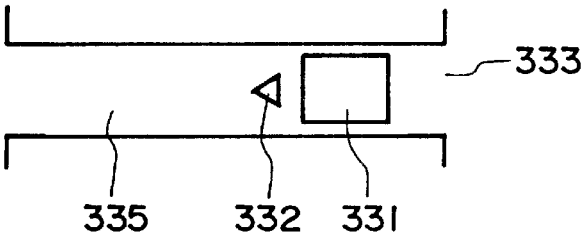

FIGS. 19A and 19B show structures of another recording head, wherein FIG. 19B shows the structure adjacent to the ejection outlet. Similarly to the foregoing embodiment, the recording head comprises a heater base plate 341 (as shown in FIG. 17), partition walls 343 for defining liquid passages 33, a transparent top plate 344 of glass contacted to the partition walls, and a heater 331 on the base plate 341 of the liquid passages. The electrotharmal transducer element corresponding to the heater 331 is energized in response to image signals through unshown electrodes.

The detailed structure of the throat 332 is as shown in FIG. 19B. More particularly, an equilateral triangular structure having a side length of 15 μm is disposed at a position 10 mm away from the heater 331 toward the liquid chamber in the manner that one side faces the heater 331. This equilateral triangular structure connects the base plate 341 and the top plate 344. The design value of the distance L1 from the heater 331 to the minimum cross-sectional area portion of the throat 332 is 15 μm; the design value of the distance L2 from the election outlet 333 to the front edge of the heater 331 is 25 μm; and the design value of the distance L3 from the heater 331 to the liquid chamber 334 is 150 μm. One recording head includes 48 nozzles at 63.5 μm intervals. The recording head satisfies the condition disclosed in U.S. Ser. No. 692,935 and the conditions described hereinbefore.

The recording head was manufactured through the same method in the foregoing embodiment, and was operated using the same ink as in the foregoing embodiment. It was driven by a pulse having a voltage of 10 V and a width of 2.5 μm. It was confirmed that the ejection was stable below the frequency of 15 kHz. When the printing operation was carried out on a recording sheet, stabilized and high quality images could be provided when any of the recording heads was used.

A transparent ink which is the same as the above-described ink but not containing the C.I. Hood Black was supplied, and the ink in the nozzle was observed by a microscope while the ink illuminated from the top plate side. It was confirmed that the bubble created by the heater communicates with the ambience through the election outlet, and bubble collapse was not observed. When the meniscus retracted the most, the meniscus extended and divided to the opposite sides of the triangular structure toward the liquid chamber.

Figure 20A:
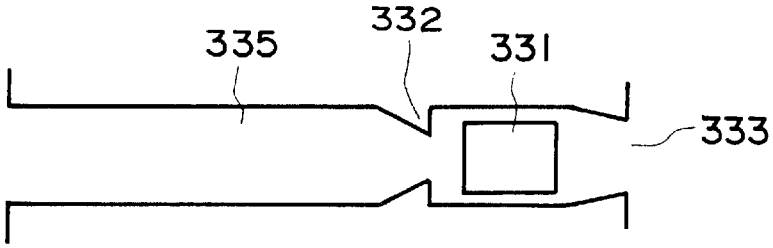
FIGS. 20A–20D are schematic illustrations of a recording head.

FIG. 20A shows another recording head and shows the structure adjacent the ejection outlet. The recording head was manufactured in the same manner, and the heater 331 is supplied with electric power in accordance with image signals through electrodes not shown. The detailed structure of the throat is such that no throat providing structure is on the base plate side or the opposite top plate side, but one is provided only on the side wall. The design distance L1 between the heater 331 and the minimum cross-sectional area portion of the throat 331 is 20 μm; the design distance L2 between the election outlet 333 and the front edge of the heater 331 is 25 μm; and the design distance L3 between the heater 331 and the liquid chamber 334 is 200 μm. The width of the throat at the minimum cross-sectional area portion is 20 μm. The liquid passage diverges from the minimum cross-sectional area position for 20 μm toward the liquid chamber; on the opposite side, the throat-forming parts are perpendicular to the side walls. Between the heater 331 and the ejection outlet 333, the side walls converge toward the ejection outlet, and the width at the orifice is 34 μm. The height of the nozzle is constant at 25 μm, and the passage width other than the throat portion is 40 μm. The heater 331 has a width of 32 μm and a length of 40 μm. One recording head has 48 nozzles at 63.5 μm intervals. This recording head also satisfies the conditions described in U.S. Ser. No. 692,935, and the conditions described hereinbefore.

The recording head was manufactured through the same process, and was driven by a pulse having a voltage of 10 V and a pulse width 2.5 μsec. The same ink was used. It was confirmed that the stabilized ejection was possible until 11 kHz. The printing operation was performed in this state, and it was confirmed that high quality and stabilized images could be produced when any of the recording heads was used.

A transparent ink which is the same as the above-described ink but not containing the C.I. Hood Black was supplied, and the ink in the nozzle was observed by a microscope while the ink was illuminated from the top plate side. It was confirmed that the bubble created by the heater communicates with the ejection outlet and no bubble collapse was observed. When the meniscus was retracted the most, the meniscus extended beyond the minimum cross-sectional area toward the liquid chamber.

Figure 20B:
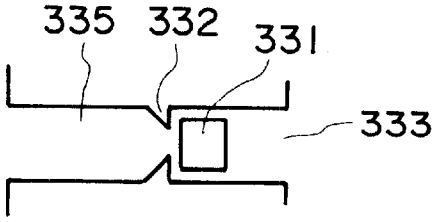

FIG. 20B shows the structure of another recording head adjacent the ejection outlet. The nozzle has a width of 30 μm at the portion other than the throat, and the height of the nozzle is 20 μm. The heater 331 has a width of 20 μm and a length of 20 μm. In this recording head, no throat providing structures are on the base plate or on the top plate facing thereto, but rather they are provided only on the side walls. The design distance L1 between the heater 331 and the minimum cross-sectional area portion of the throat 332 is 6 μm; the design distance L2 between the ejection outlet 333 and the front edge of the heater 331 is 20 μm; and the a design distance L3 between the heater 331 and the liquid chamber 334 is 80 μm. The minimum cross-sectional area portion of the throat 332 has a width of 12 μm. The passage diverges toward the ejection outlet from the minimum cross-sectional area portion by perpendicular expansion relative to the side wall. Toward the other side, that is, toward the liquid chamber, the throat diverges for 10 μm away from the minimum cross-sectional area portion. One recording head is provided with 48 nozzles at 63.5 μm intervals. Similarly to the foregoing embodiments, this recording head satisfies the conditions disclosed in U.S. Ser. No. 692,935 whereby the bubble created by the heater communicates with the ambience through the ejection outlet, and the recording head satisfies the conditions described hereinbefore.

The recording head was manufactured through the same process as in the foregoing embodiment. The same ink was used. It was driven by a pulse having a voltage of 7 V and a pulse width of 3.0 μsec. It has been confirmed that stabilized ejection was possible below 17 kHz. When the recording operation was performed on a recording sheet, it was confirmed that stable and high quality images could be provided.

A transparent ink which is the same as the above-described ink but not containing the C.I. Hood Black was supplied, and the ink in the nozzle was observed by a microscope while the ink was illuminated from the top plate side. It was been confirmed that when the meniscus retracts the most, the meniscus projects toward the liquid chamber side beyond the minimum cross-sectional area position.

Figure 20C:
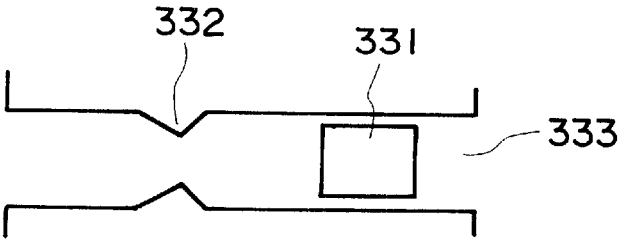

FIG. 20C shows a structure of a recording head of another example. It is modified from the example of FIG. 18 by displacing the throat 332 toward the liquid chamber. The design distance L1 between the heater 331 and the minimum cross-sectional area position is 60 μm; the design distance L2 between the ejection outlet 333 and the front edge of the heater 331 is 25 μm; and the design distance L3 between the liquid chamber side edge of the heater 331 and the liquid chamber 334 is 150 μm. The liquid passage width and the nozzle height therebetween is constant at 40 μm in width and 25 μm in height. The heater 331 has a width of 32 μm and a length of 40 μm. One recording head also has 48 nozzles at 63.5 μm intervals. The recording head also satisfies the condition disclosed in U.S. Ser. No. 692,935 for communicating the bubble created by the heater with the ambience at the time of ink ejection. However, the condition L1<2×L2 is not satisfied, but the condition L3<10×L2 is satisfied.

The recording head was manufactured in the same manner as in the example of FIG. 17. The recording head stably ejected ink below 5 kHz, but the ejection was not stable if the frequency was higher than that.

A transparent ink which is the same as the above-described ink but not containing the C.I. Hood Black was supplied, and the ink in the nozzle was observed by a microscope while the ink was illuminated from the top plate side. It was confirmed that even when the meniscus is retracted most, the meniscus was at most approx. 35 μm away from the heater rear edge and did not reach the minimum cross-sectional area position.

Figure 20D:
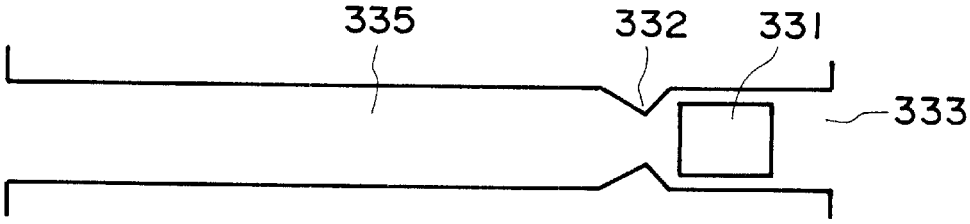

FIG. 20D shows the structure of a recording head of a further example. This corresponds to a modification of the FIG. 18 head by extending the liquid passage. The design distance LI between the heater 331 and the minimum cross-sectional area position is 15 μm; the design distance L1 between the ejection outlet 333 and the front edge of the heater 331 is 25 μm; and the design distance L3 between the liquid chamber side edge of the heater 331 and the liquid chamber 334 is 300 μm. The liquid passage width and nozzle height therebetween are constant at 40 μm is width and 25 μm in height. The heater 331 has a width of 32 μm and a length of 40 μm. One recording head comprises 48 nozzles at 63.5 μm intervals. This recording head also satisfies the conditions disclosed in U.S. Ser. No. 692,935 for ejecting the ink while communicating the bubble created by the heater with the ambience. The recording head satisfies the condition of L1<2×L2, but not the condition of L3<10×L2.

The recording head was manufactured through the same process as in the example of FIG. 17. Stable ejection was confirmed below a high frequency of 5 kHz. Beyond that, the ejection is not stabilized.

A transparent ink which is the same as the above-described ink but not containing the C.I. Hood Black, was supplied, and the ink in the nozzle was observed by a microscope while the ink was illuminated from the top plate side. It was confirmed that even when the meniscus is retracted the most, the meniscus is at most at the position approx. 12–3 μm away from the rear edge of the heater, and did not reach the minimum cross-sectional area position.

According to the above-described embodiments, the communication ejection can be accomplished more efficiently, and the refilling speed (restoration of the meniscus) is increased, thus permitting higher frequency ejections, while maintaining the advantageous effect of the invention disclosed in U.S. Ser. No. 692,935, that is, the improvement of the image quality by stabilization of the droplet volume and the prevention of mist and splashing, and advantage of the improved service life.

Accordingly, more stabilized and high quality image recording is possible.

The recording head having a throat effective for a communication ejection system may preferably satisfy the above-described conditions A–D. If they are satisfied, the communication ejection is further improved.

As described hereinbefore, in the communication ejection system, all the liquid downstream of the bubble creating position is ejected, in principle, in the form of liquid. Therefore, the ejection volume of the liquid can be determined by characteristics of the structure of the recording head, such as the distance between the ejection outlet and the bubble creating portion or the like. As a result, the ejection amount can be stabilized in a manner less constrained by the influence of the liquid temperature or the like. The description will now be made as to the recording method particularly suitable to the communication ejection system.

Figure 21A:
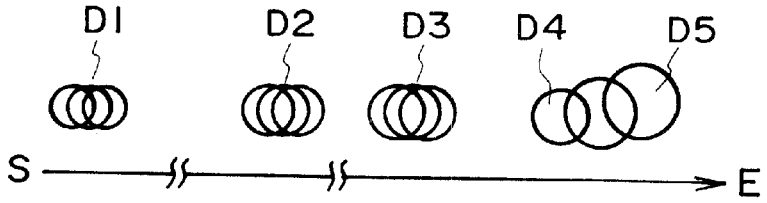
FIGS. 21A–21C illustrate the recording method according to another embodiment of the present invention.
Figure 21B:
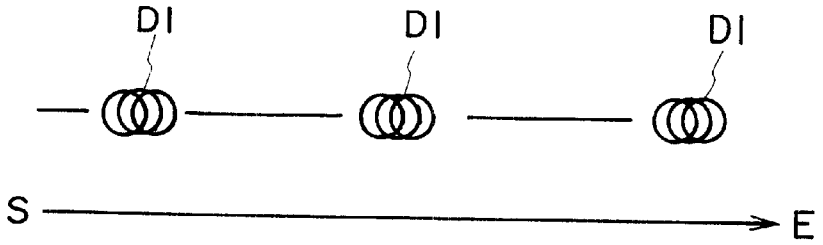
Figure 21C:
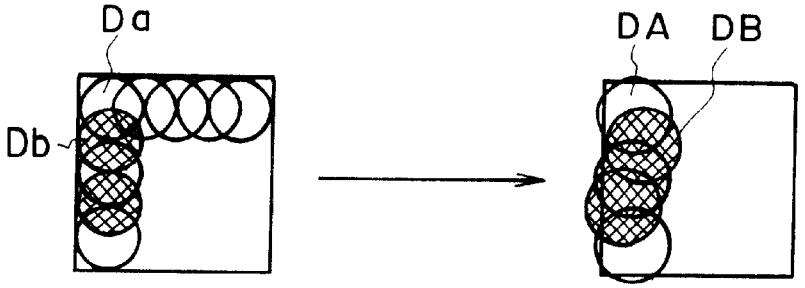

FIG. 21 illustrates the problem with conventional recording method and the image provided through the recording method of this embodiment. In the recording operations, one pixel is recorded by at least one communication ejection in which the bubble created by the heater communicates with the ambience in the droplet ejection (multi-level image formation in multi-droplet method). FIGS. 21A and 21C are related to the conventional example in which the recording head is moved from the record start position S to the record end position E. FIG. 21B is for this embodiment. In FIGS. 21A and 21C, the size of the dot image tends to gradually increase because of the heat accumulation, particularly when a number of ink droplets are shot for one pixel (D1<D2>D3>D4>D5, Da<DA, Db<DB). At the end, even the image forming position is deviated. However, according to the present invention, the bubble communicates with the ambience, and therefore, the liquid droplet is substantially free from such thermal energy. Therefore, the image provided by plural droplets is proper.

In the case of full-color image formation using the multi-level image forming method using the multi-droplet system, wherein improved tone reproduction and high resolution image are particularly desirable, it is preferable that the volume of one droplet is not more than 30 pl.

The actual preferable liquid droplet volume is determined on the basis of the required resolution, the number of tone levels, the liquid density, the recording material used or the like. For example, when 400 dot/inch recording density with 4 tone levels per pixel (1–3 shots) is desired with the usual water base ink and coated sheet, the volume of the liquid per one shot is preferably 5–15 pl. If the number of tone levels is increased to 8 (1–7 shots), 3–10 pl is desirable. When 300 dot/inch recording density with 4 tone levels per 1 pixel is desired, the liquid volume per one shot is preferably 7–25 pl. In order to obtain 8 tone levels, 4–15 pl volume is preferable.

If the liquid ejection volume per one shot exceeds 30 pl, and when yellow, magenta or cyan liquid is shot to one pixel, the liquid does not quickly dry on the recording material, with the result of feathering or another degradation of the image quality. If the recording material is plain paper, this is particularly noticeable. Even if this problem is solved by some means, it is still disadvantageous for multi-level recording, because the refilling period is long when the ejection volume is large.

The recording head has a nozzle width of 30 μm, a nozzle height of 18 μm and a nozzle length of 200 μm. It has a heater at a position 15 μm away from the ejection outlet, and the heater has a width of 22 μm and a length of 30 μm. In the recording head, 48 nozzles are arranged to satisfy 400 dot/inch recording density. Four such recording heads are prepared, and the following inks are used:

| Black | |
|---|---|
| C.I. Hood Black 2 | 3.0% by weight |
| Diethylene glycol | 15.0% by weight |

-continued

| | |
|---|---|
| N-methyl-2-pyrrolidone | 5.0% by weight |
| Ion exchange water | 77.0% by weight |
| Yellow | |
| C.I. Direct Yellow 86 | 3.0% by weight |
| Diethylene glycol | 15.0% by weight |
| N-methyl-2-pyrrolidone | 5.0% by weight |
| Ion exchange water | 77.0% by weight |
| Magenta | |
| C.I. Acid Red 35 | 3.0% by weight |
| Diethylene glycol. | 15.0% by weight |
| N-methyl-2-pyrrolidone | 5.0% by weight |
| Ion exchange water | 77.0% by weight |
| Cyan | |
| C.I. Direct Blue 119 | 3.0% by weight |
| Diethyiene glycol | 15.0% by weight |
| N-methyl-2-pyrrolidone | 5.0% by weight |
| Ion exchange water | 77.0% by weight |

Using these inks, a color image was produced on a coated sheet.

For driving the recording head, the driving voltage was 12 V with a pulse width of 3 μsec, and the liquid ejection frequency was 8 kHz, for each color. One pixel was recorded by three shots at the maximum (4 tone level recording). The produced color image had high quality without feathering. When the volume of the liquid ejected per shot was measured, it was approximately 11 pl.

Another embodiment will now be described. The recording head of the foregoing example was modified so that the nozzle width was 24 μm and the heater had a width of 20 μm and a length of 26 μm and was disposed 12 μm away from the ejection outlet. In addition, the recording density was lowered to 300 dot/inch. The same recording liquids were used. The driving voltage was 10 V, with a pulse width of 3 μsec. The frequency was 12 kHz. In this embodiment, one pixel was recorded by 7 shots at the maximum (8 tone-level color image formation). A higher quality image than the foregoing embodiment could be provided. In this embodiment, the volume of one shot was 5–6 pl.

A further embodiment will be described in which the liquid passage had a height of 13 μm, a length of 70 μm and a width of 36 μm. The distance between the ejection outlet and the heater was 25 μm. The diameter of a circular ejection outlet was 36 μm. Right below the ejection outlets, heaters (24 μm×24 μm), were arranged at the density of 400 dot/inch. The total number of the nozzles was 64. The ink used was the same as the foregoing embodiment.

The driving voltage had a voltage level of 11.5 V and a pulse width of 3 μm. The frequency of the liquid ejections was 6 kHz. The number of tone levels was 4. The produced image was practically free from the above problems, although the image had a slight feathering effect compared to the first embodiment of this group. The volume of the liquid per one shot was approx. 27 pl.

A further embodiment will be described. The recording head had a passage height of 10 μm, a passage length of 58 μm and a width of 27 μm. The distance between the ejection outlet and the heater was 20 μm. The diameter of the circular ejection outlet was 27 μm. Right below the ejection outlet 64 heaters, each having 18 μm×18 μm size, were arranged at 400 dot/inch density. The same ink was used.

The driving voltage had a voltage level of 8 V and a pulse width of 3 μm, and the ejection frequency was 12 kHz. The number of tone levels was 4. It was confirmed that a high quality image without feathering was achieved. The volume of the liquid ejected per one ejection was approx. 9 pl.

According to these embodiments of the present invention, the volume of the ejected liquid per one ejection is not more than 30 pl, so that the liquid refilling speed can be selected to be in the desirable range in the communication ejection system. In addition, the volume of the ejected liquid can be streamly stabilized, while permitting an increase of the number of tone levels in high speed recording.

In the above-described multi-droplet system, the communication ejection system is usable alone. However, it is further preferable that the above-described conditions are used and/or that the throat structure is used.

Figure 22:
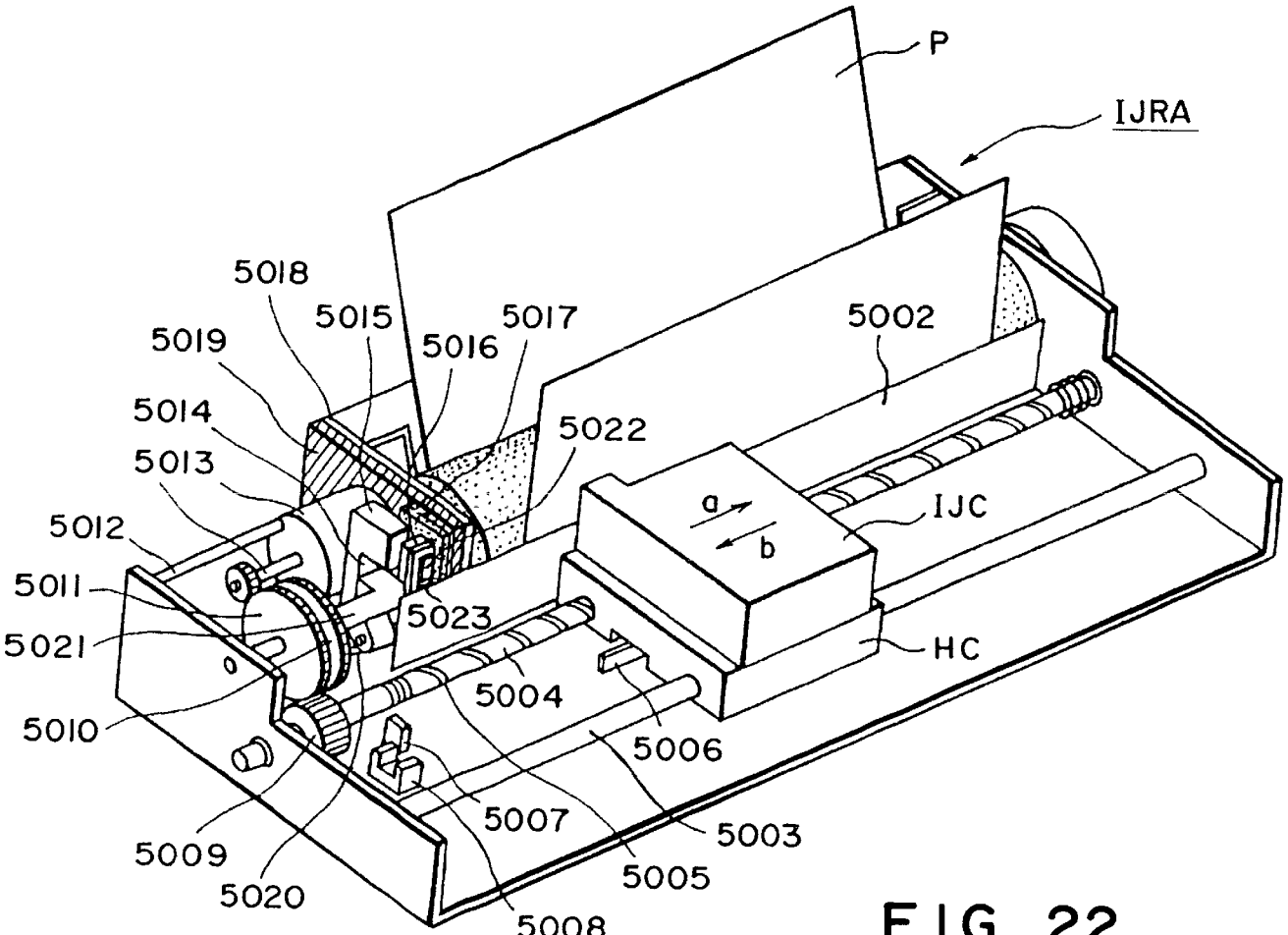
FIG. 22 illustrates an example of an apparatus according to another embodiment of the present invention.

FIG. 22 is a perspective view of an ink jet recording apparatus IJRA in which the present invention is used. A lead screw 5005 rotates by way of a drive transmission gears 5001 and 5009 by the forward and backward rotation of driving motor 5013. The lead screw 5005 has a helical groove 5004 with which a pin (not shown) of the carriage HC is engaged, by which the carriage HC is reciprecabie in directions a and b. A sheet confining plate 5002 confines the sheet on the platen over the carriage movement range. Home position detecting means 5007 and 5008 are in the form of a photocoupler to detect the presence of a lever 5006 of the carriage, in response to which the rotational direction of the motor 5013 is switched. A supporting member 5016 supports the front side surface of the recording head to a capping member 5022 for capping the recording head. Sucking means 5015 functions to suck ink from the recording head through the opening 5023 of the cap so as to recover the recording head.

A cleaning blade 5017 is moved toward the front and rear by a moving member 5017. They are supported on the supporting frame 5018 of the main assembly of the apparatus. The blade may be in another form, more particularly, a known cleaning blade. A lever 5021 is effective to start the sucking recovery operation and is moved with the movement of a cam 5020 engaging the carriage, and the driving force from the driving motor is controlled by known transmitting means such as a clutch or the like.

The capping, cleaning and sucking operations can be performed when the carriage is at the home position by the lead screw 5005 in this embodiment. However, the present invention is usable in another type of system wherein such operations are effected at a different timing. The recording apparatus is provided with electric signal supply means to supply electric signals to the recording head, to affect the recording operation. The individual structures are advantageous, and in addition, the combination thereof is further preferable.

Figure 23:
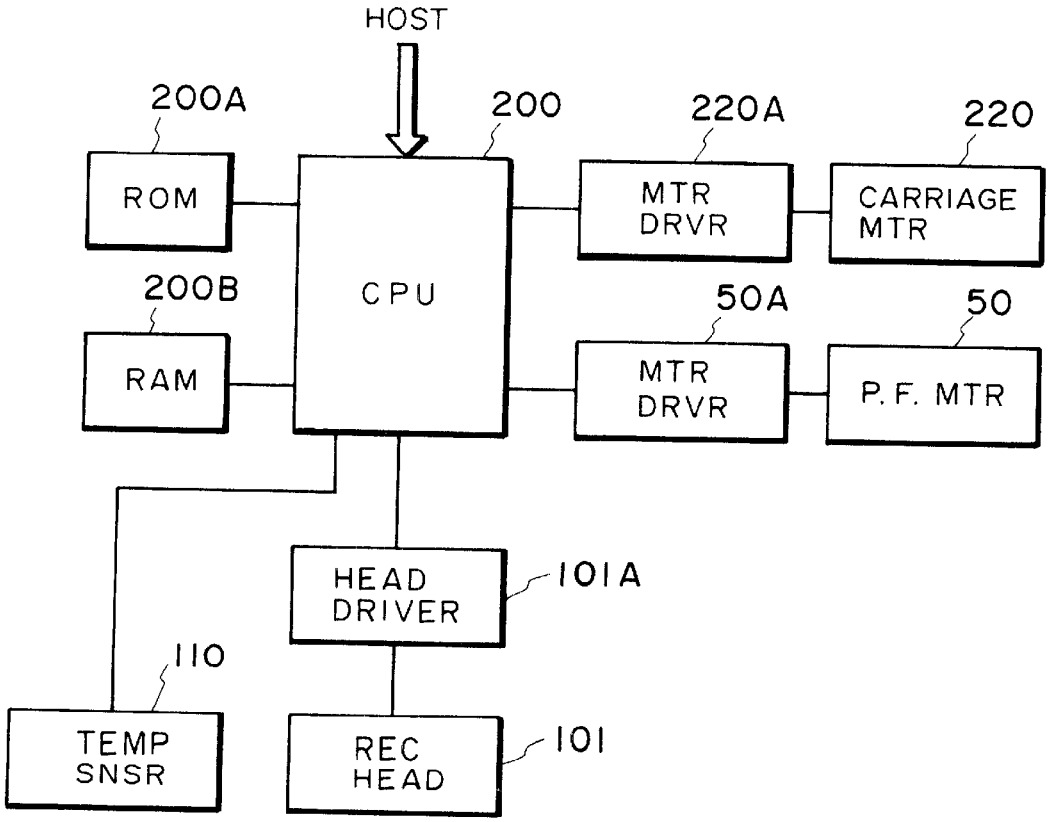
FIG. 23 is a block diagram of a control system for the apparatus according to the embodiment of the present invention.

FIG. 23 is a block diagram of a control system of an ink jet recording apparatus of FIG. 22.

In FIG. 23, CPU 200 is provided to execute control or data processing or the like for various parts of the apparatus. ROM 200A stores the processing sequence, and stores driving pulse data so that the heating action of the heater is completed prior to the communication between the bubble and the ambience after creation of the film boiling as described hereinbefore. RAM 200B is used as a work area for execution of the above operation.

The ink ejection by the recording head 101 is carried out by the CPU 200, which permits the supply of the record data and drive control signal for driving the heater to the head driver 101A. The CPU 200 also controls the carriage motor 220 for moving the carriage 102 and the sheet feed (PF) motor 50 for rotating the conveying rollers 104 and 105, through the motor drivers 220A and 50A.

It is desirable that the communication ejection is used, in which the bubble communicates with the ambience at the ejection outlet. More preferably, the foregoing conditions (1)–(3) are satisfied . In addition, the condition that the ink passage is not blocked until the bubble communicates with the ambience (the ink mass ejected through the ejection outlet by the creation of the bubble is connected with the ink in the passage) is preferably satisfied.

The present invention is effectively usable with a full-line type recording head covering the maximum recording width. The full-line recording head may comprise plural recording heads covering the recording width, or may be in the form of a single recording head covering the recording width.

The present invention is also usable with the serial type shown in FIG. 22. The recording head may be in the form of a replaceable chip which is connected with the main assembly for electricity and for ink supply when it is mounted on the recording head fixed in the main assembly or to the main assembly of the recording apparatus. The recording head may be of a cartridge type integrally having an ink container.

The recording apparatus may comprise an ejection recovery means, or assisting means to further stabilize the advantageous effect of the present invention. More particularly, there may be provided capping means for the recording head, cleaning means therefor, pressurizing or sucking means, preliminary heating means which operate with the electrothermal transducer or with another heating element, and preliminary ejecting means for ejecting the liquid other than for the recording operation.

The kinds of the recording heads used and the number thereof are not limited. For example, a single color head may be used, and plural recording heads are usable for different colors. The recording head is of integral structure for the plural colors. In addition, it may comprise plural color modes or full-color modes.

The ink jet recording apparatus may be in the form of an output terminal for an information processing apparatus such as a computer, a copying machine used with a reader, or in the form of a facsimile machine having a sending and receiving function.

While the invention has been described with reference to the structures disclosed herein, it is not confined to the details set forth and this application is intended to cover such modifications or changes as may come within the purposes of the improvements or the scope of the following claims.

What is claimed is:

1. A liquid ejection head for ejecting a liquid, comprising:

an ejection outlet for ejecting the liquid;

a liquid passage in fluid communication with said ejection outlet;

a heat generating resistor, disposed in said liquid passage, for ejecting the liquid through said ejection outlet by generation of a bubble in the liquid by generation of heat by said heat generating resistor, wherein the liquid is ejected with the bubble being in fluid communication with ambience; and a flow resistance element, disposed upstream of said heat generating resistor with respect to a flow of the liquid, for promoting fluid communication with the ambience.

2. The liquid ejection head according to claim 1, further comprising:

a liquid chamber for supplying the liquid to said liquid passages, wherein said flow resistance element has a surface for steeply narrowing a cross-sectional area of said liquid passage toward said liquid chamber to said ejection outlet.

3. The liquid ejection head according to claim 1, wherein the bubble communicates with the ambience when an internal pressure of the bubble is not more than an external pressure.

4. A recording apparatus according to claim 3, further comprising a liquid chamber for supplying the liquid to the liquid passage, wherein said flow resistance element has a surface for steeply narrowing a cross-sectional area of said liquid passage toward said liquid chamber to said ejection outlet.

5. A liquid ejection head according to claim 1, wherein said heat generating resistor faces said ejection outlet, and at least one of the following conditions is satisfied:

$\phi/Wn \leqq 1.0$ $S/Sh \leqq 3.0$ where $\phi$ is a converted orifice diameter of said ejection outlet, Wn is a passage width where said heat generating resistor is disposed, S is an area of said ejection outlet, and Sh is an area of said heat generating resistor.

6. A recording apparatus comprising:

a liquid ejection head having:

an ejection outlet for ejecting the liquid, a liquid passage in fluid communication with said ejection outlet, a heat generating resistor, disposed in said liquid passage, for ejecting the liquid through said ejection outlet by generation of a bubble in the liquid by generation of heat by said heat generating resistor, wherein the liquid is ejected with the bubble being in fluid communication with ambience, and a flow resistance element, disposed upstream of said heat generating resistor with respect to a flow of the liquid, for promoting fluid communication with the ambience.

7. A liquid jet recording method using thermal energy to eject droplets of liquid from a liquid passage through an ejection outlet, the liquid passage being provided with a heat generating resistor, wherein the following conditions are satisfied:

$$0.1 \leqq H/L \leqq 0.9$$

where L is a distance between the heat generating resistor and the ejection outlet, and H is a height of the liquid passage, and wherein a bubble created by the heat generating resistor communicates with ambience.

8. A liquid jet recording method using thermal energy to eject droplets of liquid from a liquid passage through an ejection outlet, the liquid passage being provided with a heat generating resistor, wherein the following condition is satisfied:

$$R/L \geqq 0.5$$

where L is a distance between the heat generating resistor and the ejection outlet, and R is a maximum diameter of the ejection outlet, and wherein a bubble created by the heat generating resistor communicated with ambience.

9. A liquid jet recording method using thermal energy to eject droplets of liquid from a liquid passage through an ejection outlet, the liquid passage being provided with a heat generating resistor, wherein the following condition is satisfied:

$$\phi/Wn \leqq 1.0$$

where $\phi$ is a converted diameter of the ejection outlet, and Wn is a passage width of a portion where the heat generating resistor is disposed, and wherein a bubble created by the heat generating resistor communicates with ambience.

10. A liquid jet recording method using thermal energy to eject droplets of liquid from a liquid passage through an ejection outlet, the liquid passage being provided with a heat generating resistor, wherein the following condition is satisfied:

$$S/Sh \leqq 3.0$$

where S is an area of the ejection outlet and Sh is an area of the heat generating resistor, and wherein a bubble created by the heat generating resistor communicates with ambience.

11. A method according to any one of claims 8–10, wherein, when the bubble communicates with the ambience, the liquid passage is not blocked by the bubble.

12. A method according to any one of claims 8–10, wherein the bubble communicates with the ambience when an internal pressure of the bubble is not more than external pressure.

13. A method according to any one of claims 8–10, wherein, when the bubble communicates with the ambience, an acceleration of the bubble at an ejection outlet side end is not positive.

14. A recording apparatus comprising:

a liquid ejection outlet for ejecting droplets of liquid;

a liquid passage in communication with said ejection outlets;

an electrothermal transducer having a heat generating resistor for supplying thermal energy to the liquid in said passage to eject the liquid through said ejection outlet by creation of a bubble in the liquid in said liquid passage; and signal supplying means for supplying electric signals to said resistor, wherein the following conditions are satisfied:

$$0.1 \leqq H/L \leqq 0.9$$

where L is a distance between said heat generating resistor and said ejection outlet, and H is a height of said liquid passage, and wherein a bubble created by said heat generating resistor communicates with ambience.

15. A recording apparatus comprising:

a liquid ejection outlet for ejecting droplets of liquid;

a passage in communication with said ejection outlet;

an electrothermal transducer having a heat generating resistor for supplying thermal energy to the liquid in said passage to eject the liquid through said ejection outlet by creation of a bubble in the liquid in said liquid passage; and signal supplying means for supplying electric signals to said resistor, wherein the following condition is satisfied:

$$R/L \geqq 0.5$$

where L is a distance between said heat generating resistor and said ejection outlet, and R is a maximum diameter of the ejection outlet, and wherein a bubble created by said heat generating resistor communicates with ambience.

16. A recording apparatus comprising:

a liquid ejection outlet for ejecting droplets of liquid;

a liquid passage in communication with said ejection outlet;

electrothermal transducer having a heat generating resistor for supplying thermal energy to the liquid in said passage to eject the liquid through said ejection outlet by creation of a bubble in the liquid in said liquid passage; and signal supplying means for supplying electric signals to said resistor, wherein the following condition is satisfied:

$$\phi/Wn \leqq 1.0$$

where $\phi$ is a converted diameter of said ejection outlet, and Wn is a passage width of a portion where said heat generating resistor is disposed, and wherein a bubble created by said heat generating resistor communicates with ambience.

17. A recording apparatus comprising:

a liquid ejection outlet for ejecting liquid of droplets;

a liquid passage in communication with said ejection outlet;

an electrothermal transducer having a heat generating resistor for supplying thermal energy to the liquid in said passage to eject the liquid through said ejection outlet by creation of a bubble in the liquid in said liquid passage; and signal supplying means for supplying electric signals to said resistor, wherein the following condition is satisfied:

$$S/Sh \leqq 3.0$$

where S is an area of said ejection outlet, and Sh is an area of said heat generating resistor, and wherein a bubble created by said heat generating resistor communicates with ambience.

18. An apparatus according to any one of claims 14–17, wherein, when the bubble communicates with the ambience, said liquid passage is not blocked by the bubble.

19. An apparatus according to any one of claims 14–17, wherein the bubble communicates with the ambience when an internal pressure of the bubble is not more than external pressure.

20. An apparatus according to any one of claims 14–17, wherein, when the bubble communicates with the ambience, an acceleration of the bubble at an ejection outlet side end is not positive.

21. A recording head comprising:

a liquid ejection outlet for ejecting droplets of liquid;

a liquid passage in communication with said ejection outlet; and an electrothermal transducer having a heat generating resistor for supplying thermal energy to the liquid in said passage to eject the liquid through said outlet by creation of a bubble in the liquid in said liquid passage, wherein the following conditions are satisfied:

$$0.1 \leqq H/L \leqq 0.9$$

where L is a distance between said heat generating resistor and said ejection outlet, and H is a height of said liquid passage, and wherein a bubble created by said heat generating resistor communicates with ambience.

22. A recording head comprising:

a liquid ejection outlet for ejecting droplets of liquid;

a liquid passage in communication with said ejection outlet; and an electrothermal transducer having a heat generating resistor for supplying thermal energy to the liquid in said passage to eject the liquid through said ejection outlet by creation of a bubble in the liquid in said liquid passage, wherein the following condition is satisfied:

$$R/L \geqq 0.5$$

where L is a distance between heat generating resistor and said ejection outlet, and R is a maximum diameter of the ejection outlet, and wherein a bubble created by said heat generating resistor communicates with ambience.

23. A recording head comprising:

a liquid ejection outlet for ejecting droplets of liquid;

a liquid passage in communication with said ejection outlet; and an electrothermal transducer having a heat generating resistor for supplying thermal energy to the liquid in said passage to eject the liquid through said ejection outlet by creation of a bubble in the liquid in said liquid passage, wherein the following condition is satisfied:

$$\phi/Wn \leqq 1.0$$

where $\phi$ is a converted diameter of said ejection outlet, and Wn is a passage width of a portion where said heat generating resistor is disposed, and wherein a bubble created by said heat generating resistor communicates with ambience.

24. A recording head comprising:

a liquid ejection outlet for ejecting droplets of liquid;

a liquid passage in communication with said ejection outlet;

an electrothermal transducer having a heat generating resistor for supplying thermal energy to the liquid in said passage to eject the liquid through said ejection outlet by creation of a bubble in the liquid in said liquid passage, wherein the following condition is satisfied:

$$S/Sh \leqq 3.0$$

where S is an area of said ejection outlet and Sh is an area of said heat generating resistor, and wherein a bubble created by said heat generating resistor communicates with ambience.

25. A liquid jet recording method in which liquid droplets are ejected through an ejection outlet by thermal energy provided by a heat generating resistor by creating a bubble in the liquid in said liquid passage, wherein the bubble communicates with ambience when an internal pressure of the bubble is not more than an ambient pressure, and one pixel is recorded by plural droplets of the liquid ejected through the ejection outlet.

26. A method according to claim 25, wherein a volume of the liquid ejected in each ejection is not more than 30 pl.

* * * * *

UNITED STATES PATENT AND TRADEMARK OFFICE

CERTIFICATE OF CORRECTION

PATENT NO. : 6,467,882 B2
DATED : October 22, 2002
INVENTOR(S) : Toshiharu Inui et al.

It is certified that error appears in the above-identified patent and that said Letters Patent is hereby corrected as shown below:

Title page,
Item [56], References Cited, FOREIGN PATENT DOCUMENTS
"61185455" should read -- 61-185455 --; and "61197246" should read -- 61-197246 --.
Item [30], Foreign Application Priority Data, "4-283232" should read -- 3-283232 --.
Item [57], ABSTRACT
Line 16, "the." should read -- the --; and
Line 17, "heat" should read -- the heat -- and "with" should read -- with the --.

Column 1,
Line 66, "bubbles" should read -- bubble --.

Column 3,
Line 4, "mots" should read -- most --.

Column 4,
Line 28, "as" should read -- an --; and
Line 66, "FIGS. 5A-B5" should read -- FIGS. 5A-5B --.

Column 6,
Line 21, "above described" should read -- above-described --; and
Line 62, "it it" should read -- it is --.

Column 7,
Line 67, "bubbly" should read -- bubble --.

Column 8,
Line 11, "Other preferably," should read -- Preferably, --; and
Line 21, "2b)." should read -- (2b). --.

Column 9,
Line 28, "municate" should read -- municate with --;
Line 30, "easily,this" should read -- easily. This --; and
Line 45, "the," should read -- the --.

Column 10,
Line 26, "become" should read -- becomes --; and
Line 60, "on a" should read -- on an --.

UNITED STATES PATENT AND TRADEMARK OFFICE

CERTIFICATE OF CORRECTION

PATENT NO. : 6,467,882 B2
DATED : October 22, 2002
INVENTOR(S) : Toshiharu Inui et al.

It is certified that error appears in the above-identified patent and that said Letters Patent is hereby corrected as shown below:

Column 11,
Line 32, "edgy" should read -- edge --; and
Line 39, "ambiance," should read -- ambience, --.

Column 15,
Line 64, "higher" should read -- higher, --.

Column 16,
Line 20, "condition" should read -- conditions --.

Column 19,
Line 8, "7(a)-7(b)." should read -- 7(a)-7(f). --.

Column 20,
Line 31, "bubbles-is" should read -- bubble is --.

Column 21,
Line 49, "it" should read -- if --; and
Line 53, "affect" should read -- effect --.

Column 24,
Line 27, "creates" should read -- created --.

Column 30,
Line 67, "satisfied ." should read -- satisfied. --.

Column 32,
Line 1, "claim 3" should read -- claim 1 --.

Column 34,
Line 5, "electrothermal" should read -- an electrothermal --; and
Line 23, "liquid of droplets;" should read -- droplets of liquid; --.

UNITED STATES PATENT AND TRADEMARK OFFICE

CERTIFICATE OF CORRECTION

PATENT NO. : 6,467,882 B2
DATED : October 22, 2002
INVENTOR(S) : Toshiharu Inui et al.

It is certified that error appears in the above-identified patent and that said Letters Patent is hereby corrected as shown below:

Column 35,
Line 16, "heat" should read -- said heat --.

Signed and Sealed this

Twenty-eighth Day of June, 2005

JON W. DUDAS
*Director of the United States Patent and Trademark Office*